US012702915B2

(12) United States Patent
Su et al.

(10) Patent No.: US 12,702,915 B2
(45) Date of Patent: Aug. 11, 2026

(54) SYSTEMS, APPARATUSES, AND METHODS FOR ANCHORING AND FASTENING OF SKATE TRUCK KINGPINS

(71) Applicant: Mesa Distribution, Inc., Los Alamitos, CA (US)

(72) Inventors: Yuche Su, Taipei (TW); Joseph Pulsifer, Atascadero, CA (US)

(73) Assignee: Mesa Distribution, Inc., Los Alamitos, CA (US)

( * ) Notice: Subject to any disclaimer, the term of this patent is extended or adjusted under 35 U.S.C. 154(b) by 185 days.

(21) Appl. No.: 18/377,925

(22) Filed: Oct. 9, 2023

(65) Prior Publication Data

US 2024/0115926 A1 Apr. 11, 2024

Related U.S. Application Data

(60) Provisional application No. 63/413,968, filed on Oct. 7, 2022.

(51) Int. Cl.
*A63C 17/01* (2006.01)
*A63C 17/02* (2006.01)

(52) U.S. Cl.
CPC ..... *A63C 17/012* (2013.01); *A63C 17/015* (2013.01)

(58) Field of Classification Search
CPC ... A63C 17/012; A63C 17/015; A63C 17/011; A63C 17/014; A63C 17/0093; A63C 17/02
See application file for complete search history.

(56) References Cited

U.S. PATENT DOCUMENTS

| | | | | |
|---|---|---|---|---|
| 4,047,725 | A * | 9/1977 | Pinchock | A63C 17/012 280/11.28 |
| 6,428,023 | B2 | 8/2002 | Reyes et al. | |
| 7,007,957 | B1 * | 3/2006 | Lee | A63C 17/015 280/809 |
| 7,413,200 | B2 | 8/2008 | Horn | |
| 8,998,225 | B2 * | 4/2015 | Magee | A63C 17/0093 280/87.042 |
| 9,199,157 | B2 | 12/2015 | Yamada | |
| 10,391,384 | B2 * | 8/2019 | Powell | A63C 17/0093 |
| 10,507,375 | B2 | 12/2019 | Sandusky | |
| 11,224,793 | B1 * | 1/2022 | Piumarta | A63C 17/012 |
| 2022/0126193 | A1 | 4/2022 | Piumarta | |

OTHER PUBLICATIONS

International Search Report and Written Opinion dated Feb. 22, 2024, regarding PCT/US2023/34729.

* cited by examiner

*Primary Examiner* — John D Walters
(74) *Attorney, Agent, or Firm* — Snell & Wilmer LLP

(57) ABSTRACT

Systems, apparatuses, and methods for fastening components of equipment, for example, a skateboard or a roller skate, among other types of sporting boards, sports apparatuses, or wheeled sporting apparatuses. Fastening systems disclosed herein may be utilized to couple a skateboard truck to a skateboard deck. The fastening systems may add a high level of stability and durability to the coupling or the anchoring of, e.g., a kingpin to a baseplate on the skateboard truck. For example, the high level of stability and durability to the coupling or the anchoring may be achieved via a sleeve (e.g., a flanged sleeve) that is formed of high-strength material and press-fit into an aperture on the skateboard truck baseplate.

20 Claims, 24 Drawing Sheets

SYSTEMS, APPARATUSES, AND METHODS FOR ANCHORING AND FASTENING OF SKATE TRUCK KINGPINS

CROSS-REFERENCE TO RELATED APPLICATIONS

This application claims the benefit of U.S. Provisional Application No. 63/413,968, filed Oct. 7, 2022, which is incorporated by reference herein in its entirety and is hereby expressly made a part of this specification. Any and all priority claims identified in the Application Data Sheet, or any correction thereto, are hereby incorporated by reference herein.

FIELD OF THE DISCLOSURE

This disclosure generally relates to assemblies for mounting wheels to the underside of a skateboard deck or a roller skate boot. More specifically, it relates to systems, apparatuses, and methods for anchoring and fastening of skate truck kingpins.

The present disclosure may provide improved means for anchoring and fastening of a kingpin to a baseplate. The systems, apparatuses, and methods disclosed herein may improve the stability and the durability of the anchoring of a kingpin while minimizing a reduction in steering range and a compromise in the steering performance.

BACKGROUND

Conventional skateboards and roller skates are equipped with steering mechanisms known as trucks. The trucks (e.g., a pair of trucks) are mounted on the underside of a board or deck of a skateboard or a boot on a roller skate opposite to each other—e.g., one in the front and another one in the rear. Each truck carries two wheels, one at each end of an axle that fits through the truck. Each truck usually contains two donut-shaped elastomeric suspension elements, known as bushings, which are mounted onto a kingpin bolt that is fastened in various ways to the truck baseplate.

Conventional skate trucks follow a basic design in which an axle pivots about an arm attached at one end to the center portion of the axle. The other end of this pivot arm is loosely fitted, at angles typically measuring 30 to 50 degrees, into a simple sleeve (called a "pivot cup" and normally formed of plastic) that is mounted in a baseplate, thus forming a ball-like joint. A pair of bushings, usually doughnut-shaped and made of urethane plastic of varying hardnesses on the Shore "A" scale, is mounted on a kingpin bolt fixed at various angles in the baseplate on the side of the axle opposite the pivot cup. These bushings grasp a ring within, or extending from, the axle body so that the axle is suspended between the ball joint and the bushings. By adjusting the kingpin bolt or a kingpin fastener, the tension on the bushings may be increased or decreased, thereby varying the balance between turning stability and turning ease.

Certain modern skating stunts involve purposefully scraping parts of the truck, particularly the top of an axle hanger or a yoke, against protrusions in the riding environment. This is called "grinding," and the related stunts frequently involve high impacts as well as abrasion to the truck body. Over time, the grinding can wear away a significant portion of the top of the axle hanger. This increasingly exposes adjacent parts of the truck, particularly the top of the kingpin assembly, to damaging impact and abrasion.

Skate truck kingpins are often pressed in from the underside of the baseplate, with the fastener, typically a hexagonal nylon locknut, resting above the top bushing. Alternatively, the fastener is sometimes pressed into a pocket on the underside of the baseplate, with the kingpin inserted from the top—a so-called "inverted" kingpin orientation, commonly chosen for skate applications where the top of the kingpin assembly is more likely to undergo high impacts and abrasion. The inverted kingpin orientation allows the kingpin head to be recessed away from such impacts and abrasion further than the fastening nut could be recessed in the opposite (i.e., "non-inverted") kingpin orientation.

The standard constructions seen in the prior art feature kingpin anchoring and fastening systems that are prone to sub-optimal performance, premature wear, and catastrophic damage. For example, the kingpin's anchor in the baseplate—typically a straight aperture in cast aluminum—allows for excessive lateral flexing, which may compromise steering performance. Over time, the anchor may loosen or ovalize, compromising the overall function of the truck.

Furthermore, in the inverted kingpin orientation, high impacts on the kingpin head can force the fastener out of its pocket on the underside of the baseplate—resulting in a "sunken" kingpin that may rattle and may provide unstable riding performance. In the prior art, the fastener is often a sleeved nylon locknut pressed in from the underside of the baseplate and formed of soft steel in order to permit installation of the nylon lock insert. When pushed out of place by high impacts, this comparatively soft fastener is usually damaged, and its aperture on the underside of the baseplate is often deformed. Replacement sleeved fasteners are not easy to find on the open market and difficult to install, and the entire baseplate or truck must typically be replaced.

As an attempt to partially address the above issues with the inverted kingpin orientation, some truck makers reduce the thickness of the kingpin head and even the heights of the top and the bottom bushings. These measures attempt to increase the recess of the kingpin head and to protect it from impacts and abrasion as the top of the hanger is progressively worn from grinding. However, shorter bushings also result in reduced steering range and compromised steering performance.

SUMMARY

Systems, apparatuses, and methods disclosed herein may be directed to improvements in the field of board sports, or sporting boards, or more particularly skateboarding. Increased interest in such activities has increased the need for improved equipment for such endeavors, including the increased stability and durability in the anchoring of a kingpin while minimizing a reduction in steering range and a compromise in the steering performance.

Generally disclosed herein are fastening or anchoring systems for fastening components of equipment, specifically a skateboard, among other types of sporting boards or sports apparatuses or wheeled sporting apparatuses. Fastening or anchoring systems disclosed herein may be utilized for coupling a kingpin bolt (also referred to herein as a kingpin) of a skateboard to a baseplate (e.g., the truck baseplate) of the skateboard. The fastening or anchoring systems disclosed herein may utilize one or more sleeve-related features that may improve the stability and the durability of the anchoring of the kingpin while minimizing a reduction in steering range and a compromise in the steering performance.

The systems, methods, and apparatuses disclosed herein may provide for improved anchoring of the kingpin to the baseplate, with a reduced possibility of damage to the baseplate, the kingpin, or other components of a truck during use of the skateboard.

The systems, methods, and apparatuses disclosed herein may provide for a high level of stability and durability to the anchoring of the kingpin.

In a first aspect, a skateboard truck, comprising: a kingpin; a baseplate configured to be attached to a skateboard deck, the baseplate including an aperture, the aperture including a sidewall bounding an interior of the aperture for receiving the kingpin; and a sleeve configured to extend within the aperture and including an interior channel for receiving the kingpin, the sleeve including an exterior surface having one or more engagement features for engaging the sidewall of the aperture.

Implementations of the aspects may include one or more of the following. The one or more engagement features may include a variation in a surface profile of the exterior surface. The one or more engagement features may include one or more grooves or ridges for engaging the sidewall of the aperture. The one or more engagement features may be configured for a press fit with the sidewall of the aperture. The one or more engagement features may be made of a material that is harder than the sidewall of the aperture. The sleeve may be made of a material that is harder than material that the baseplate is made out of. An interior surface of the sleeve facing the interior channel may include threading for engaging the kingpin. A retainer may be for engaging the kingpin within the interior of the aperture. The retainer may comprise a clip. The retainer may include a protrusion, and the kingpin includes a channel for receiving the protrusion. An interior surface of the sleeve facing the interior channel may include a recess for receiving the retainer. A securement ring may be for securing the retainer within the interior of the aperture. The securement ring may be configured to extend within the aperture and includes an exterior surface having one or more engagement features for engaging the sidewall of the aperture. A fastener may be for fastening the kingpin to the baseplate. The sleeve may be a flanged sleeve. The aperture may have a length, and the sleeve is configured to extend for only a portion of the length of the aperture. The baseplate may include an underside support surface for facing towards the skateboard deck and a top side support surface that is opposite the underside support surface, and the aperture extends from the underside support surface to the top side support surface. The baseplate may include a pocket having the underside support surface. The kingpin may include a head configured to be positioned with the top side support surface disposed intermediate the head and the skateboard deck. The kingpin may include a head configured to be positioned between the underside support surface and the skateboard deck.

In a second aspect, a skateboard truck, comprising: a baseplate having an aperture, the baseplate configured to be attached to a skateboard deck; a flanged sleeve configured to extend within the aperture and including an interior channel, a first flange positioned at a first end portion of the flanged sleeve, and a second flange positioned at a second end portion of the flanged sleeve that is opposite the first end portion; and a kingpin configured to extend within the interior channel of the flanged sleeve.

Implementations of the aspects may include one or more of the following. The baseplate may include an underside support surface for facing towards the skateboard deck and a top side support surface that is opposite the underside support surface, and the first flange is configured to be positioned at the underside support surface and the second flange is configured to be positioned at the top side support surface. The baseplate may include a pocket having the underside support surface. The aperture may include a stepped recess at the top side support surface, and the second flange is configured to extend within the stepped recess. The first flange may be configured to protrude from the underside support surface. The kingpin may include a head configured to be positioned between the underside support surface and the skateboard deck. The flanged sleeve may include a central shaft, and one or more of the first flange or the second flange is integral with the central shaft. The flanged sleeve may include a central shaft, and one or more of the first flange or the second flange comprises a deformed end of the central shaft. The flanged sleeve may include a central shaft, and one or more of the first flange or the second flange is non-integral with the central shaft. The flanged sleeve may include a central shaft, and one or more of the first flange or the second flange comprises a fastener coupled to the central shaft. The fastener may comprise one or more of a nut, a clip, or a ring. The flanged sleeve may include a central shaft having an exterior surface, the exterior surface including an engagement surface for engaging one or more of the first flange or the second flange. The engagement surface may comprise threading. The engagement surface may comprise a recess in the exterior surface. One or more of the first flange or the second flange may comprise a curable material. One or more of the first flange or the second flange may comprise an adhesive. The flanged sleeve may include an interior surface facing towards the interior channel, the interior surface including threading for engaging the kingpin. The flanged sleeve may include an exterior surface having a plurality of knurls or flutes. The flanged sleeve may include a collar insert for increasing friction with the kingpin. A fastener may be for fastening the kingpin to the baseplate.

In a third aspect, a skateboard truck, comprising: a baseplate configured to be attached to a skateboard deck, the baseplate including an aperture having a first portion having a first diameter and a second portion having a second diameter that is less than the first diameter; a sleeve configured to extend within the first portion of the aperture and including an interior channel; and a kingpin configured to extend within the interior channel of the sleeve.

Implementations of the aspects may include one or more of the following. A transition between the first portion and the second portion may comprise a radially inward extending step. The sleeve may be configured to seat upon the radially inward extending step. The baseplate may include an underside support surface for facing towards the skateboard deck and a top side support surface that is opposite the underside support surface, and the first portion is disposed intermediate the second portion and the top side support surface. The sleeve may be configured to be flush with the top side support surface when the sleeve extends within the first portion of the aperture. The sleeve may include an exterior surface, and further comprising a retainer for contacting the exterior surface to retain the sleeve within the first portion of the aperture. The retainer may comprise a pin. The sleeve may include a collar insert for increasing friction with the kingpin. The sleeve may include an interior surface facing towards the interior channel, the interior surface including threading for engaging the kingpin. A fastener may be for fastening the kingpin to the baseplate.

In a fourth aspect, a skateboard truck, comprising: a baseplate having an aperture, the baseplate for attachment to a skateboard deck; a flanged sleeve extending within the aperture; and a kingpin seated within the flanged sleeve.

Implementations of the aspects may include one or more of the following. The flanged sleeve may have a plurality of knurls or flutes. The aperture may comprise a stepped aperture. The baseplate may include an underside support surface for facing towards the skateboard deck and a top side support surface that is opposite the underside support surface, and the flanged sleeve includes a flange configured to be positioned at the top side support surface. The kingpin may include a head configured to be positioned between the underside support surface and the skateboard deck. The kingpin may include a head configured to be positioned with the top side support surface disposed intermediate the head and the skateboard deck. The flanged sleeve may include an interior channel and an interior surface facing towards the interior channel, the interior surface including threading for engaging the kingpin. The flanged sleeve may include a collar insert for increasing friction with the kingpin. The flanged sleeve may include an exterior surface having a plurality of grooves or ridges for engaging a sidewall of the aperture. A fastener may be for fastening the kingpin to the baseplate.

Aspects include a skateboard including any of the skateboard trucks disclosed herein.

Aspects include a method of manufacturing or assembling at least a portion of any of the skateboard trucks or skateboards disclosed herein.

In a fifth aspect, a skateboard comprising: a skateboard deck; a pair of skateboard trucks coupled to the skateboard deck, each truck configured with: a kingpin, a baseplate attached to the skateboard deck, the baseplate including an aperture, the aperture including a sidewall bounding an interior of the aperture that receives the kingpin, a sleeve extending within the aperture and including an interior channel receiving the kingpin, the sleeve including an exterior surface having one or more engagement features engaging the sidewall of the aperture, and a hanger with an axle supported by the baseplate; and a set of wheels coupled to each of the pair of skateboard trucks via each axle.

Implementations of the aspects may include one or more of the following. The one or more engagement features may include a variation in a surface profile of the exterior surface. The one or more engagement features may include one or more grooves or ridges engaging the sidewall of the aperture. The one or more engagement features may have a press fit with the sidewall of the aperture. The one or more engagement features may be made of a material that is harder than the sidewall of the aperture. The sleeve may be made of a material that is harder than material that the baseplate is made out of. An interior surface of the sleeve facing the interior channel may include threading for engaging the kingpin. A retainer may be for engaging the kingpin within the interior of the aperture. The retainer may comprise a clip. The retainer may include a protrusion, and the kingpin includes a channel receiving the protrusion. An interior surface of the sleeve facing the interior channel may include a recess receiving the retainer. A securement ring may secure the retainer within the interior of the aperture. The securement ring may extend within the aperture and includes an exterior surface having one or more engagement features engaging the sidewall of the aperture. A fastener may be for fastening the kingpin to the baseplate. The sleeve may be a flanged sleeve. The aperture may have a length, and the sleeve extends for only a portion of the length of the aperture. The baseplate may include an underside support surface facing towards the skateboard deck and a top side support surface that is opposite the underside support surface, and the aperture extends from the underside support surface to the top side support surface. The baseplate may include a pocket having the underside support surface. The kingpin may include a head positioned with the top side support surface disposed intermediate the head and the skateboard deck. The kingpin may include a head positioned between the underside support surface and the skateboard deck.

In a sixth aspect, a skateboard comprising: a skateboard deck; a pair of skateboard trucks coupled to the skateboard deck, each truck configured with: a baseplate attached to the skateboard deck and having an aperture, a flanged sleeve extending within the aperture and including an interior channel, a first flange positioned at a first end portion of the flanged sleeve, and a second flange positioned at a second end portion of the flanged sleeve that is opposite the first end portion, a kingpin extending within the interior channel of the flanged sleeve, and a hanger with an axle supported by the baseplate; and a set of wheels coupled to each of the pair of skateboard trucks via each axle.

Implementations of the aspects may include one or more of the following. The baseplate may include an underside support surface facing towards the skateboard deck and a top side support surface that is opposite the underside support surface, and the first flange is positioned at the underside support surface and the second flange is positioned at the top side support surface. The baseplate may include a pocket having the underside support surface. The aperture may include a stepped recess at the top side support surface, and the second flange extends within the stepped recess. The first flange may protrude from the underside support surface. The kingpin may include a head positioned between the underside support surface and the skateboard deck. The flanged sleeve may include a central shaft, and one or more of the first flange or the second flange is integral with the central shaft. The flanged sleeve may include a central shaft, and one or more of the first flange or the second flange comprises a deformed end of the central shaft. The flanged sleeve may include a central shaft, and one or more of the first flange or the second flange is non-integral with the central shaft. The flanged sleeve may include a central shaft, and one or more of the first flange or the second flange comprises a fastener coupled to the central shaft. The fastener may comprise one or more of a nut, a clip, or a ring. The flanged sleeve may include a central shaft having an exterior surface, the exterior surface including an engagement surface engaging one or more of the first flange or the second flange. The engagement surface may comprise threading. The engagement surface may comprise a recess in the exterior surface. One or more of the first flange or the second flange may comprise a curable material. One or more of the first flange or the second flange may comprise an adhesive. The flanged sleeve may include an interior surface facing towards the interior channel, the interior surface including threading engaging the kingpin. The flanged sleeve may include an exterior surface having a plurality of knurls or flutes. The flanged sleeve may include a collar insert for increasing friction with the kingpin. A fastener may be for fastening the kingpin to the baseplate.

In a seventh aspect, a skateboard comprising: a skateboard deck; a pair of skateboard trucks coupled to the skateboard deck, each truck configured with: a baseplate attached to the skateboard deck, the baseplate including an aperture having a first portion having a first diameter and a second portion having a second diameter that is less than the first diameter, a sleeve extending within the first portion of the aperture and including an interior channel, and a kingpin extending within the interior channel of the sleeve, and a hanger with an axle supported by the baseplate; and a set of wheels coupled to each of the pair of skateboard trucks via each axle.

Implementations of the aspects may include one or more of the following. A transition between the first portion and the second portion may comprise a radially inward extending step. The sleeve may seat upon the radially inward extending step. The baseplate may include an underside support surface facing towards the skateboard deck and a top side support surface that is opposite the underside support surface, and the first portion is disposed intermediate the second portion and the top side support surface. The sleeve may be flush with the top side support surface when the sleeve extends within the first portion of the aperture. The sleeve may include an exterior surface, and further comprising a retainer contacting the exterior surface to retain the sleeve within the first portion of the aperture. The retainer may comprise a pin. The sleeve may include a collar insert for increasing friction with the kingpin. The sleeve may include an interior surface facing towards the interior channel, the interior surface including threading engaging the kingpin. A fastener may fasten the kingpin to the baseplate.

In an eighth aspect, a skateboard comprising: a skateboard deck; a pair of skateboard trucks coupled to the skateboard deck, each truck configured with: a baseplate attached to the skateboard deck, the baseplate having an aperture, a flanged sleeve extending within the aperture, a kingpin seated within the flanged sleeve, and a hanger with an axle supported by the baseplate; and a set of wheels coupled to each of the pair of skateboard trucks via each axle.

Implementations of the aspects may include one or more of the following. The flanged sleeve may have a plurality of knurls or flutes. The aperture may comprise a stepped aperture. The baseplate may include an underside support surface facing towards the skateboard deck and a top side support surface that is opposite the underside support surface, and the flanged sleeve includes a flange positioned at the top side support surface. The kingpin may include a head positioned between the underside support surface and the skateboard deck. The kingpin may include a head positioned with the top side support surface disposed intermediate the head and the skateboard deck. The flanged sleeve may include an interior channel and an interior surface facing towards the interior channel, the interior surface including threading engaging the kingpin. The flanged sleeve may include a collar insert for increasing friction with the kingpin. The flanged sleeve may include an exterior surface having a plurality of grooves or ridges engaging a sidewall of the aperture. A fastener may be for fastening the kingpin to the baseplate.

In a ninth aspect, a method of assembling at least a portion of a skateboard truck or a skateboard, the method comprising: providing a baseplate configured to be attached to a skateboard deck, the baseplate including an aperture, the aperture including a sidewall bounding an interior of the aperture for receiving a kingpin; and inserting a sleeve within the aperture, the sleeve including an interior channel for receiving the kingpin, the sleeve including an exterior surface having one or more engagement features for engaging the sidewall of the aperture.

Implementations of the aspects may include one or more of the following. The one or more engagement features may include a variation in a surface profile of the exterior surface. The one or more engagement features may include one or more grooves or ridges for engaging the sidewall of the aperture. The one or more engagement features may be configured for a press fit with the sidewall of the aperture. The one or more engagement features may be made of a material that is harder than the sidewall of the aperture. The sleeve may be made of a material that is harder than material that the baseplate is made out of. An interior surface of the sleeve facing the interior channel may include threading for engaging the kingpin. A method may further comprise inserting a retainer for engaging the kingpin within the interior of the aperture. The retainer may comprise a clip. The retainer may include a protrusion, and the kingpin includes a channel for receiving the protrusion. An interior surface of the sleeve facing the interior channel may include a recess for receiving the retainer. A method may further comprise inserting a securement ring for securing the retainer within the interior of the aperture. The securement ring may be configured to extend within the aperture and includes an exterior surface having one or more engagement features for engaging the sidewall of the aperture. A method may further comprise inserting a kingpin through the interior channel of the sleeve; and coupling a fastener to the kingpin for fastening the kingpin to the baseplate. The sleeve may be a flanged sleeve. The aperture may have a length, and the sleeve extends for only a portion of the length of the aperture. The baseplate may include an underside support surface for facing towards the skateboard deck and a top side support surface that is opposite the underside support surface, and the aperture extends from the underside support surface to the top side support surface. The baseplate may include a pocket having the underside support surface. The kingpin may include a head configured to be positioned with the top side support surface disposed intermediate the head and the skateboard deck. The kingpin may include a head configured to be positioned between the underside support surface and the skateboard deck.

In a tenth aspect, a method of assembling at least a portion of a skateboard truck or a skateboard, the method comprising: providing a baseplate having an aperture, the baseplate configured to be attached to a skateboard deck; and disposing a flanged sleeve within the aperture, the flanged sleeve including an interior channel for receiving a kingpin, a first flange positioned at a first end portion of the flanged sleeve, and a second flange positioned at a second end portion of the flanged sleeve that is opposite the first end portion.

Implementations of the aspects may include one or more of the following. The baseplate may include an underside support surface for facing towards the skateboard deck and a top side support surface that is opposite the underside support surface, and the first flange is positioned at the underside support surface and the second flange is positioned at the top side support surface. The baseplate may include a pocket having the underside support surface. The aperture may include a stepped recess at the top side support surface, and the second flange extends within the stepped recess. The first flange may protrude from the underside support surface. The kingpin may include a head positioned between the underside support surface and the skateboard deck. The flanged sleeve may include a central shaft, and one or more of the first flange or the second flange is integral with the central shaft. The flanged sleeve may include a central shaft, and one or more of the first flange or the second flange comprises a deformed end of the central shaft. The flanged sleeve may include a central shaft, and one or more of the first flange or the second flange is non-integral with the central shaft. The flanged sleeve may include a central shaft, and one or more of the first flange or the second flange comprises a fastener coupled to the central shaft. The fastener may comprise one or more of a nut, a clip, or a ring. The flanged sleeve may include a central shaft having an exterior surface, the exterior surface including an engagement surface for engaging one or more of the first flange or the second flange. The engagement surface may comprise threading. The engagement surface may comprise a recess in the exterior surface. One or more of the first flange or the second flange may comprise a curable material. One or more of the first flange or the second flange may comprise an adhesive. The flanged sleeve may include an interior surface facing towards the interior channel, the interior surface including threading for engaging the kingpin. The flanged sleeve may include an exterior surface having a plurality of knurls or flutes. The flanged sleeve may include a collar insert for increasing friction with the kingpin. The method may further comprise inserting a kingpin through the interior channel of the sleeve; and coupling a fastener to the kingpin for fastening the kingpin to the baseplate.

In an eleventh aspect, a method of assembling at least a portion of a skateboard truck or a skateboard, the method comprising: providing a baseplate configured to be attached to a skateboard deck, the baseplate including an aperture having a first portion having a first diameter and a second portion having a second diameter that is less than the first diameter; and inserting a sleeve within the first portion of the aperture, the sleeve including an interior channel for receiving a kingpin.

Implementations of the aspects may include one or more of the following. A transition between the first portion and the second portion may comprise a radially inward extending step. The sleeve may seat upon the radially inward extending step. The baseplate may include an underside support surface for facing towards the skateboard deck and a top side support surface that is opposite the underside support surface, and the first portion is disposed intermediate the second portion and the top side support surface. The sleeve may be flush with the top side support surface when the sleeve extends within the first portion of the aperture. The sleeve may include an exterior surface, and further comprising inserting a retainer for contacting the exterior surface to retain the sleeve within the first portion of the aperture. The retainer may comprise a pin. The sleeve may include a collar insert for increasing friction with the kingpin. The sleeve may include an interior surface facing towards the interior channel, the interior surface including threading for engaging the kingpin. The method may further comprise inserting a kingpin through the interior channel of the sleeve; and coupling a fastener to the kingpin for fastening the kingpin to the baseplate.

In a twelfth aspect, a method of assembling at least a portion of a skateboard truck or a skateboard, comprising: providing a baseplate having an aperture, the baseplate for attachment to a skateboard deck; and disposing a flanged sleeve within the aperture, the flanged sleeve having an interior channel for receiving a kingpin.

Implementations of the aspects may include one or more of the following. The flanged sleeve may have a plurality of knurls or flutes. The aperture may comprise a stepped aperture. The baseplate may include an underside support surface for facing towards the skateboard deck and a top side support surface that is opposite the underside support surface, and the flanged sleeve includes a flange positioned at the top side support surface. The kingpin may include a head configured to be positioned between the underside support surface and the skateboard deck. The kingpin may include a head configured to be positioned with the top side support surface disposed intermediate the head and the skateboard deck. The flanged sleeve may include an interior surface facing towards the interior channel, the interior surface including threading for engaging the kingpin. The flanged sleeve may include a collar insert for increasing friction with the kingpin. The flanged sleeve may include an exterior surface having a plurality of grooves or ridges for engaging a sidewall of the aperture. The method may further comprise inserting a kingpin through the interior channel of the sleeve; and coupling a fastener to the kingpin for fastening the kingpin to the baseplate.

Any of the features of any of the aspects, including but not limited to any examples of any of the first through twelfth aspects referred to above, is applicable to all other aspects and examples identified herein, including but not limited to any examples of any of the first through twelfth aspects referred to above. Moreover, any of the features of an example of the various aspects, including but not limited to any examples of any of the first through twelfth aspects referred to above, is independently combinable, partly or wholly with other examples described herein in any way, e.g., one, two, or three or more examples may be combinable in whole or in part. Further, any of the features of an example of the various aspects, including but not limited to any examples of any of the first through twelfth aspects referred to above, may be made optional to other aspects or examples. Any aspect or example of a method can be performed by a system or apparatus of another aspect or example, and any aspect or example of a system or apparatus can be configured to perform a method of another aspect or example, including but not limited to any examples of any of the first through twelfth aspects referred to above. Methods may include methods of assembling any of the components disclosed herein. One or more components of aspects or examples disclosed herein may be provided solely, or in combination with other components disclosed herein.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter, nor is it intended for use as an aid in determining the scope of the claimed subject matter. The claimed subject matter is not limited to implementations that solve any or all disadvantages noted in any part of this disclosure.

DETAILED DESCRIPTION

Figure 1:
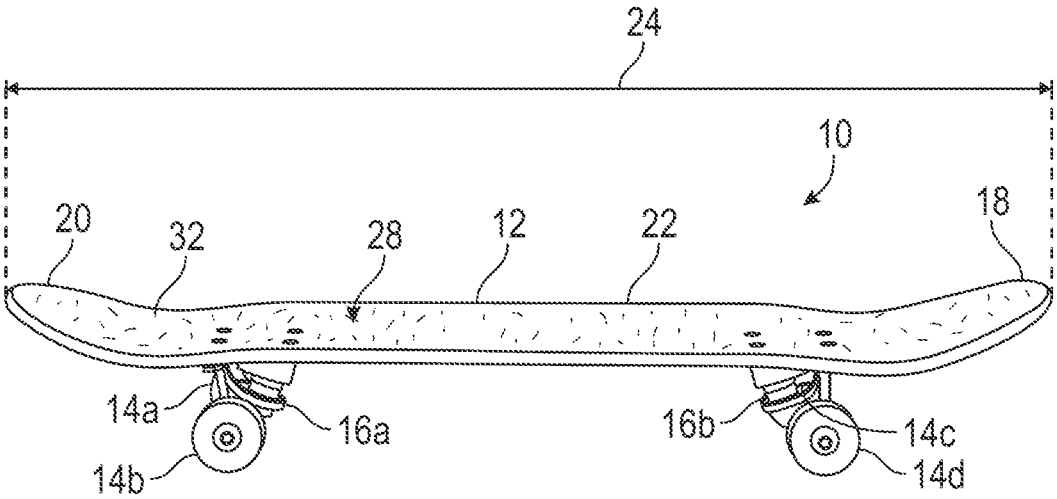
FIG. 1 illustrates a side view of a skateboard system according to examples herein.

FIG. 1 illustrates an exemplary skateboard system 10 (which may be referred to herein as a skateboard). The skateboard system 10 may include a skateboard deck 12, a plurality of wheels 14*a-d*, and a plurality of trucks 16*a, b* (e.g., a pair of skateboard trucks 16*a, b* coupled to the deck 12) that may be configured to support the plurality of wheels 14*a-d*. In examples, the skateboard system 10 may include a greater or fewer number of components, or modifications of the components illustrated in FIG. 1 as desired.

The deck 12 may comprise a board of the skateboard system 10. A user (e.g., a rider) may stand upon the deck 12 to ride the skateboard and to perform a variety of tricks if desired. The deck 12 may include a nose 18 at the front of the deck 12, a tail 20 at the rear of the deck 12, and a main body 22 between the nose 18 and the tail 20. One or both of the nose 18 or the tail 20 may be angled relative to the main body 22, or may be planar with the main body 22 in examples as desired.

Figure 3:
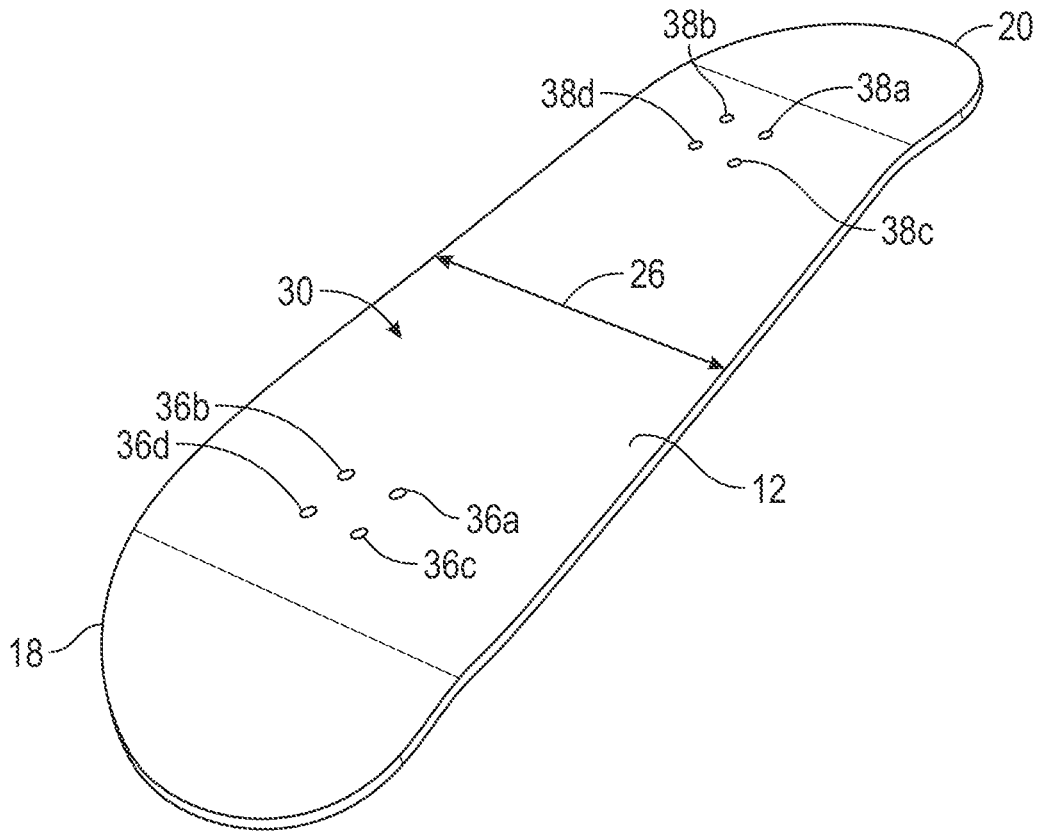
FIG. 3 illustrates a lower perspective view of a deck of a skateboard according to examples herein.

The deck 12 may have a length 24 and a width 26 (marked in FIG. 3), which may be varied in examples as desired.

The deck 12 may include a top surface 28 or upper surface, and a bottom surface 30 or lower surface (marked in FIG. 3) facing opposite the top surface 28. The top surface 28 in examples may be a surface for a user (e.g., a rider) to stand upon when riding the skateboard.

In examples, the top surface 28 may include a layer of grip tape 32 that may be applied to a surface of a board forming the deck 12. The grip tape 32 may be utilized to increase the grip of a user (e.g., a rider) upon the deck 12. The grip tape 32 may cover the entirety of the surface of the board or may cover only a portion of the board.

The deck 12 may include holes 36*a-d*, 38*a-d* (marked in FIG. 3) that may be utilized to couple the deck 12 to the trucks 16*a, b*. The holes 36*a-d*, 38*a-d* may pass through the deck 12 from the top surface 28 to the bottom surface 30. A first group, or leading group, of the holes 36*a-d* may be utilized to couple to a first truck 16*b* or leading truck of the skateboard. A second group, or tailing group, of the holes 38*a-d* may be utilized to couple to a second truck 16*a* or tailing truck of the skateboard.

The first group of the holes 36*a-d* may be spaced from one other substantially in a rectangular configuration. The position of the first group of holes 36*a-d* may correspond to the position of holes of the first truck 16*b* for coupling with the deck 12. The second group of the holes 38*a-d* may similarly be positioned substantially in a rectangular configuration and may correspond to the position of holes of the second truck 16*a* for coupling with the deck 12. The first group of the holes 36*a-d* may be positioned proximate the nose 18, and the second group of the holes 38*a-d* may be positioned proximate the tail 20.

Figure 2:
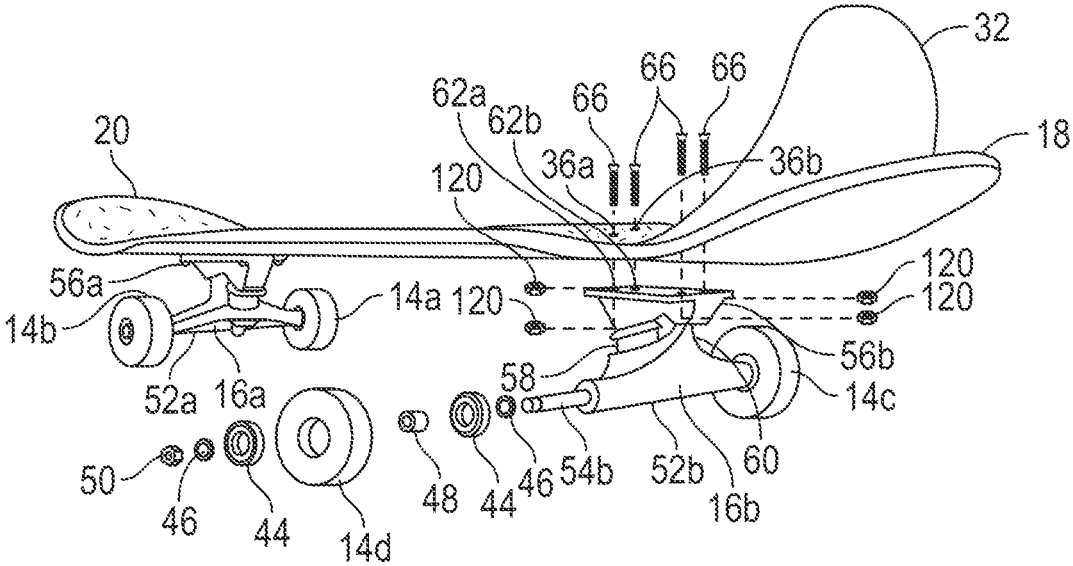
FIG. 2 illustrates a lower perspective view of a partially assembled skateboard according to examples herein.

Referring to FIG. 2, the plurality of wheels 14*a-d* may be configured to roll to provide movement of the skateboard. Each wheel 14*a-d* may be coupled to a respective truck 16*a, b* via one or more bearings 44 that may allow the wheel 14*a-d* to spin. Two bearings may be fit into pockets integrated into the wheel body. One or more washers 46 or spacers 48 may be utilized for coupling to the respective truck 16*a, b* as well. One or more fasteners 50 such as nuts may be utilized to couple the wheels 14*a-d* to a respective truck 16*a, b*.

The trucks 16*a, b* may comprise steering mechanisms. Trucks serve four main purposes: 1) to connect the wheels to the deck or boot; 2) to provide wide-ranging steering response, whereby the wheel axles swivel to create a finite turning radius when, by means of lateral weight shifts, the skater tilts the deck or boot about its longitudinal axis; 3) by means of a resilient suspension system, to smoothly and predictably resist the skater's varying lateral weight shifts, thus stabilizing linear rolling motion and providing control over the steering response; and 4) by means of the same resilient suspension system, to return the deck or boot to the neutral, non-turning position after the skater discontinues a lateral weight shift.

The trucks 16*a, b* may be mounted on the underside or bottom of the deck, one in front and one in rear. Each truck may carry two wheels, one at each end of the truck's axle. The trucks 16*a, b* may be configured to support the plurality of wheels 14*a-d*. The trucks 16*a, b* may be configured to allow the plurality of wheels 14*a-d* to pivot with respect to the deck 12 (e.g., a length-wise axis of the deck 12) to allow the skateboard to turn. Each truck 16*a, b* may include a respective truck hanger 52*a, b* that may include a respective axle 54*a, b* (marked in FIG. 4). The wheels 14*a-d* may be configured to couple to a respective axle 54*a, b* and rotate about the axle 54*a, b*. Sets of the wheels 14*a-d* may be coupled to each pair of trucks 16*a, b* via each axle 54*a, b*.

Each truck hanger 52*a, b* may be supported by a respective baseplate 56*a, b*. Each truck hanger 52*a, b* may be configured to pivot relative to a respective baseplate 56*a, b* to allow the skateboard to turn. A variety of pivot mechanisms may be utilized to allow the truck hanger 52*a, b* to pivot. As shown in FIG. 2, for example, a pivot mechanism utilizing a bushing 58, a kingpin (surrounded by the bushing 58), and a pivot bushing 60 (or pivot cup) may be utilized. In examples, other forms of pivot mechanisms may be utilized as desired.

Figure 4:
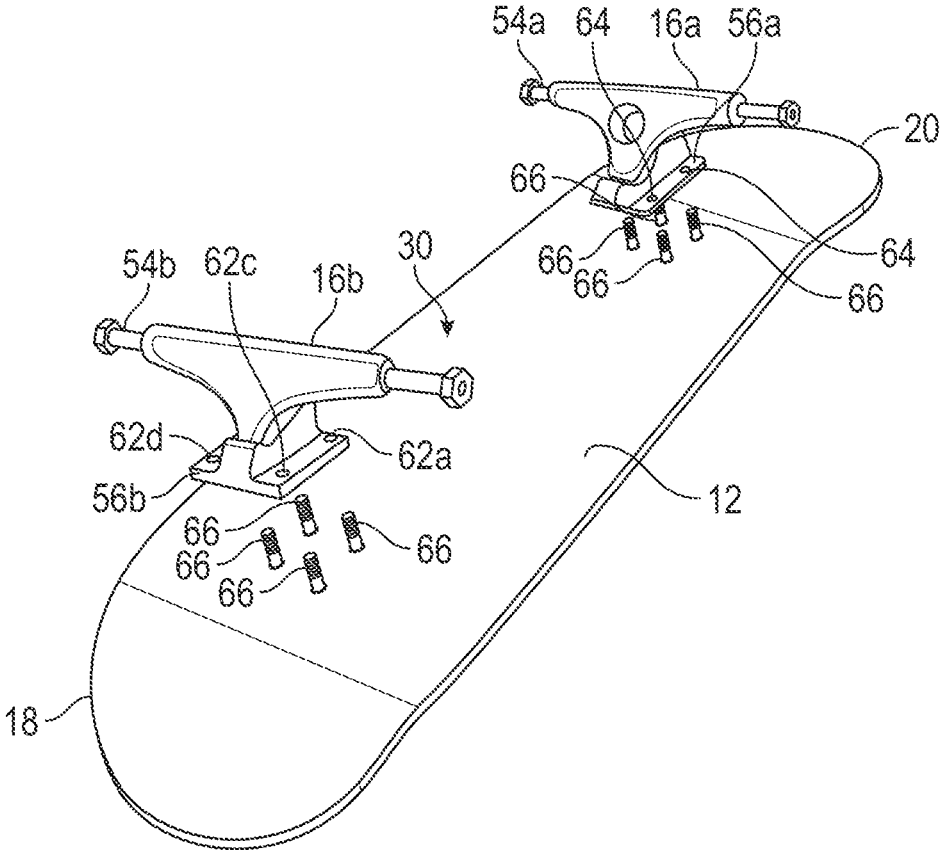
FIG. 4 illustrates a lower perspective view of the deck of the skateboard shown in FIG. 3 with fasteners protruding through the deck and trucks positioned over the fasteners.

The baseplate 56*a, b* may be utilized to couple the respective truck 16*a, b* to the deck 12. The baseplate 56*a, b* may include a flattened plate or may have other configurations as desired. The baseplate 56*a, b* may be configured to be placed against the bottom surface 30 of the deck 12. Referring also to FIG. 4, in examples, a baseplate 56*b* may include respective holes 62*a-d*, and a baseplate 56*a* may include holes 64 that may be utilized to couple the respective truck 16*a, b* to the deck 12. The holes 62*a-d*, 64 may be spaced to align with the respective holes 36*a-d*, 38*a-d* of the deck 12, and the holes 62*a-d* (as well as the holes 64) may each be positioned substantially in a rectangular configuration as desired. Other configurations may be utilized in examples. The truck 16*a, b* may be anchored to the bottom surface 30 by a plurality of bolts 66 being inserted from the side of the top surface 28 of the deck 12, fastened through the respective holes 36*a-d*, 38*a-d* of the deck 12 and the respective holes 62*a-d*, 64, and secured via a plurality of fasteners 120 (e.g., on or within the baseplate 56*a, b*).

Figure 5:
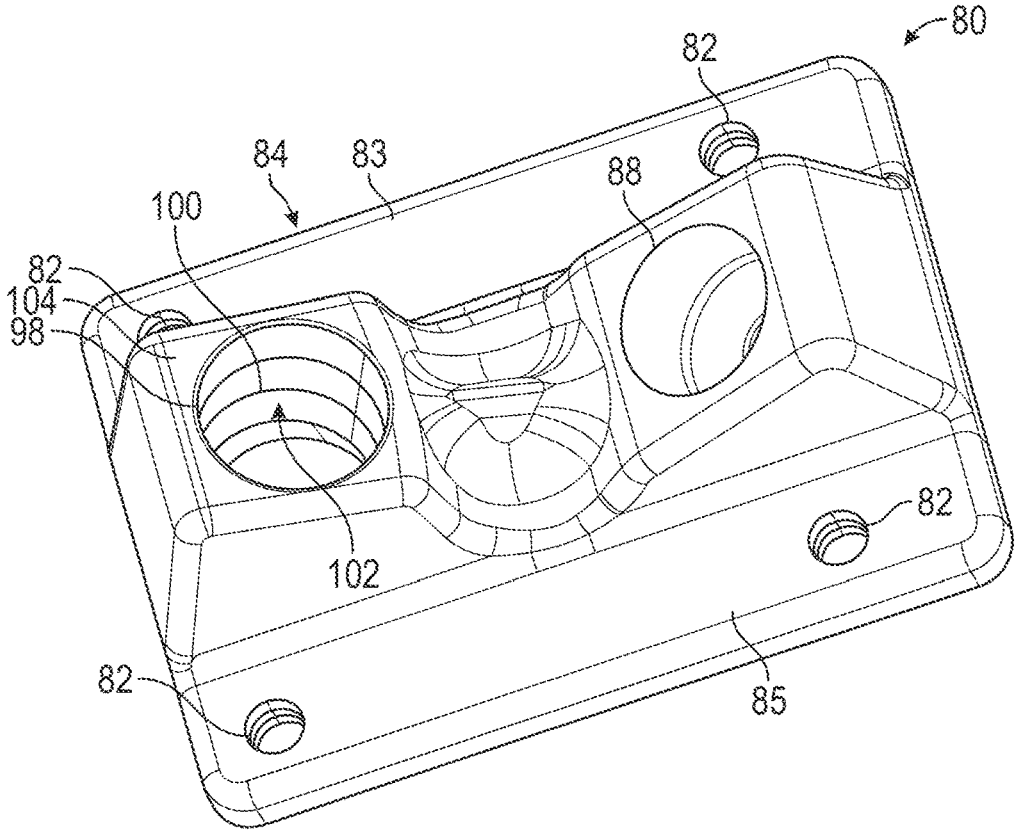
FIG. 5 illustrates a top side perspective view of a baseplate of a truck.

FIG. 5 illustrates a top perspective view of a baseplate 80 that may be utilized in examples herein. The baseplate 80 may include features disclosed in regard to other forms of baseplates disclosed herein, for example features disclosed in regard to the baseplates 56*a, b* or other forms of baseplates. The baseplate 80 may be configured to be attached to a skateboard deck 12, and may include holes 82 that may be utilized in a similar manner as the holes 62*a-d*, 64 discussed in regard to FIG. 4.

Figure 6:
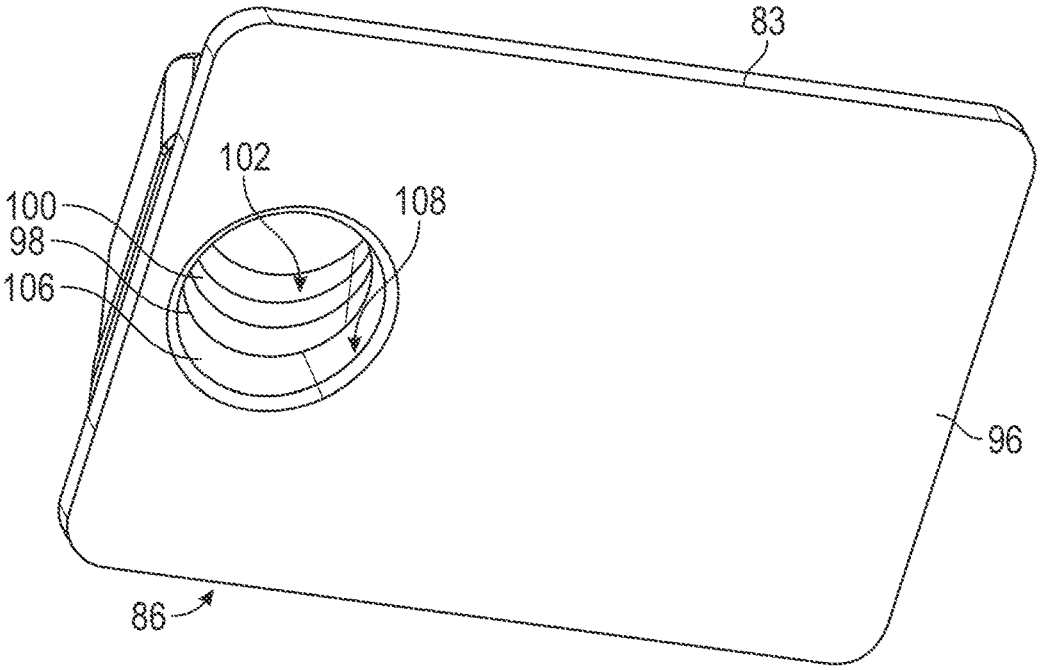
FIG. 6 illustrates an underside perspective view of a baseplate of a truck.

The baseplate 80 may include a main body 83 having a top side 84 (shown in FIG. 5) and an underside 86 (shown in FIG. 6). The top side 84 may face towards the ground and away from the deck 12 in use, and the underside 86 may face opposite the top side 84 and towards the deck 12 in use.

Figure 17:
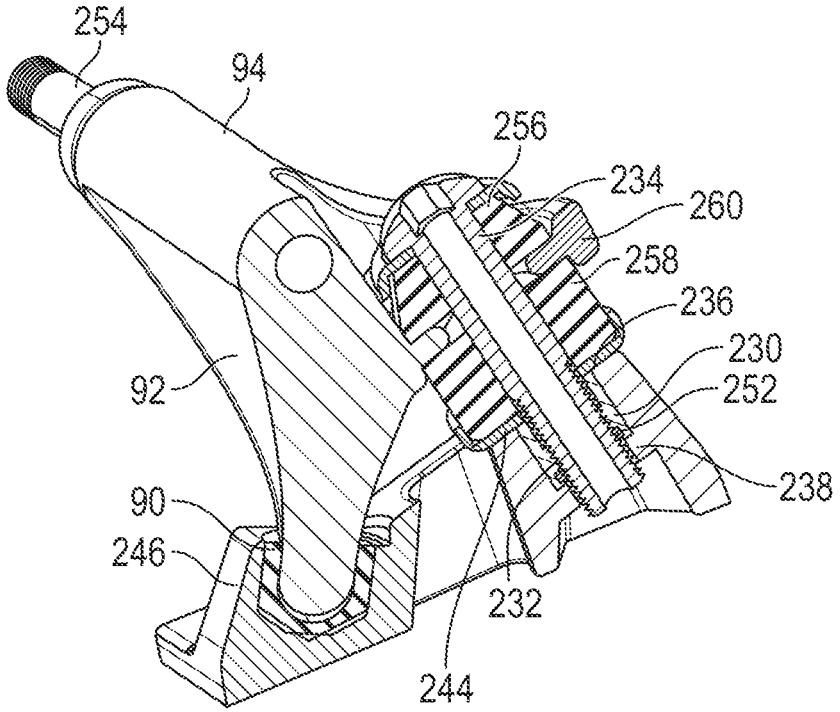
FIG. 17 illustrates a perspective cross sectional view of a sleeve within an aperture of a baseplate.

Referring to FIG. 5, the top side 84 may include an opening 88 that may include a pivot cup 90 (as marked in FIG. 17) for receiving an end of a pivot arm 92 coupled to a hanger 94 (as represented in FIG. 17 for example). Features of components of a truck as shown in FIG. 17 may be utilized with any example disclosed herein.

The top side 84 may include a main body surface 85 that may be contoured to a desired shape of the top side 84. For example, the main body surface 85 may be shaped to form contours as shown in FIG. 5 for example.

Referring to FIG. 6, the underside 86 may include a main body surface 96. The main body surface 96 of the underside 86 may be flat to allow for a flat mating surface with the bottom surface or lower surface of the deck 12.

Referring to FIGS. 5 and 6, the baseplate 80 may include an aperture 98. The aperture 98 may be configured to receive a kingpin. The aperture 98 may extend from the top side 84 to the underside 86 of the baseplate 80 and may have a length.

The aperture 98 may include a sidewall 100 that bounds an interior 102 of the aperture 98 for receiving the kingpin. The sidewall 100 may have a cylindrical shape to thus define a cylindrical interior 102 or interior channel of the aperture 98, or may have another shape in examples as desired (e.g, rectangular or hexagonal, among other shapes).

An upper or top side end of the aperture 98 may extend to a top side support surface 104 (marked in FIG. 5). Referring to FIG. 6, a lower or underside end of the aperture 98 may extend to an underside support surface 106. The underside support surface 106 may face towards the skateboard deck 12, and the top side support surface 104 may be opposite the underside support surface 106 and face away from the skateboard deck 12 (and towards the ground in use). The aperture 98 may extend from the underside support surface 106 to the top side support surface 104.

Figure 12:
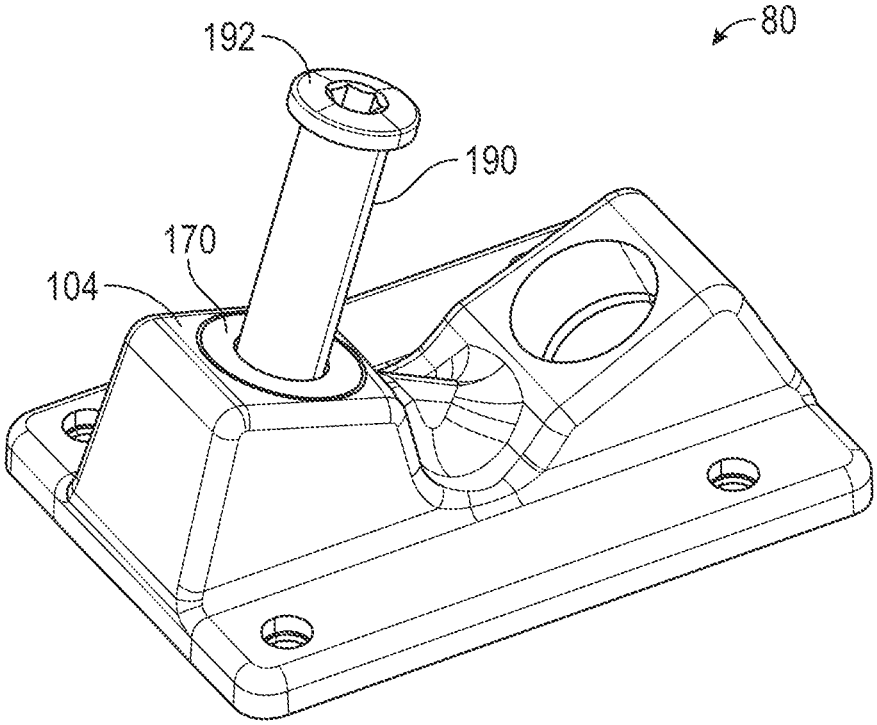
FIG. 12 illustrates a top side perspective view of a baseplate of a truck including the assembly shown in FIG. 7.
Figure 13:
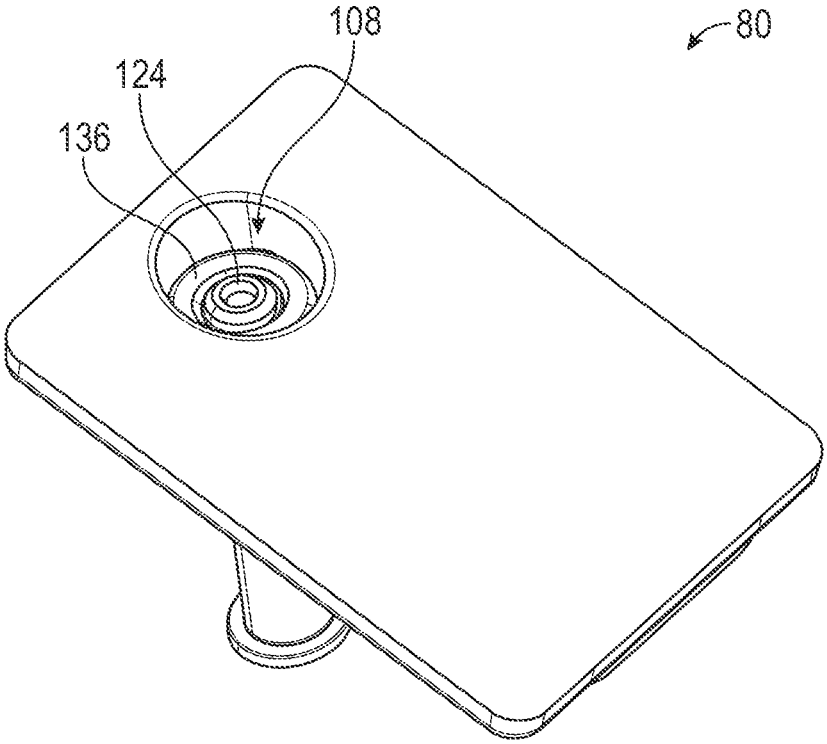
FIG. 13 illustrates an underside perspective view of the baseplate of the truck shown in FIG. 12.
Figure 19:
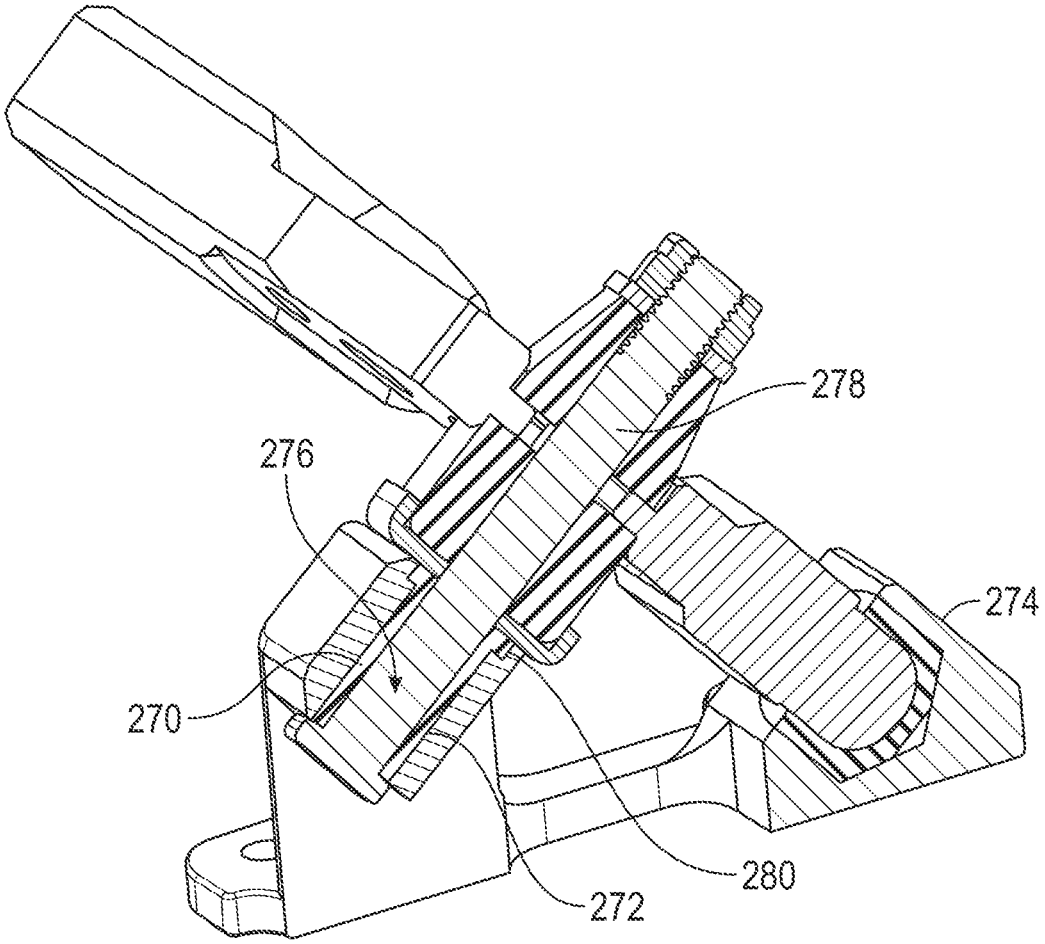
FIG. 19 illustrates a perspective cross sectional view of a sleeve within an aperture of a baseplate.

In examples, the underside 86 may include a pocket 108 or recess that includes the underside support surface 106. The pocket 108 may be configured to receive a fastener for engaging the kingpin in an "inverted kingpin" configuration (as represented in FIGS. 12 and 13 for example), or may receive the head of the kingpin in a standard or "non-inverted" configuration as represented in FIG. 19 for example. The pocket 108 may provide space for the kingpin fastener or the head of the kingpin, so that either does not impact the bottom surface of the deck 12 in assembly. The underside support surface 106 may be angled and extend in a top-wise direction from a flattened surface of the main body surface 96 in examples (as shown in FIG. 6 for example). Other shapes or configurations of underside support surfaces 106 may be utilized in examples. The angle of the underside support surface 106 may vary from the angle of the sidewall 100 in examples (e.g., have a lesser vertical angle than the sidewall 100). The underside support surface 106, for example, may taper to the sidewall 100. In examples, the underside support surface 106 may be perpendicular to the direction of the sidewall 100. In examples, the angle of the top side support surface 104 (marked in FIG. 5) may be transverse, angled, or perpendicular to the direction of the sidewall 100 or other angles may be utilized in examples.

Figure 7:
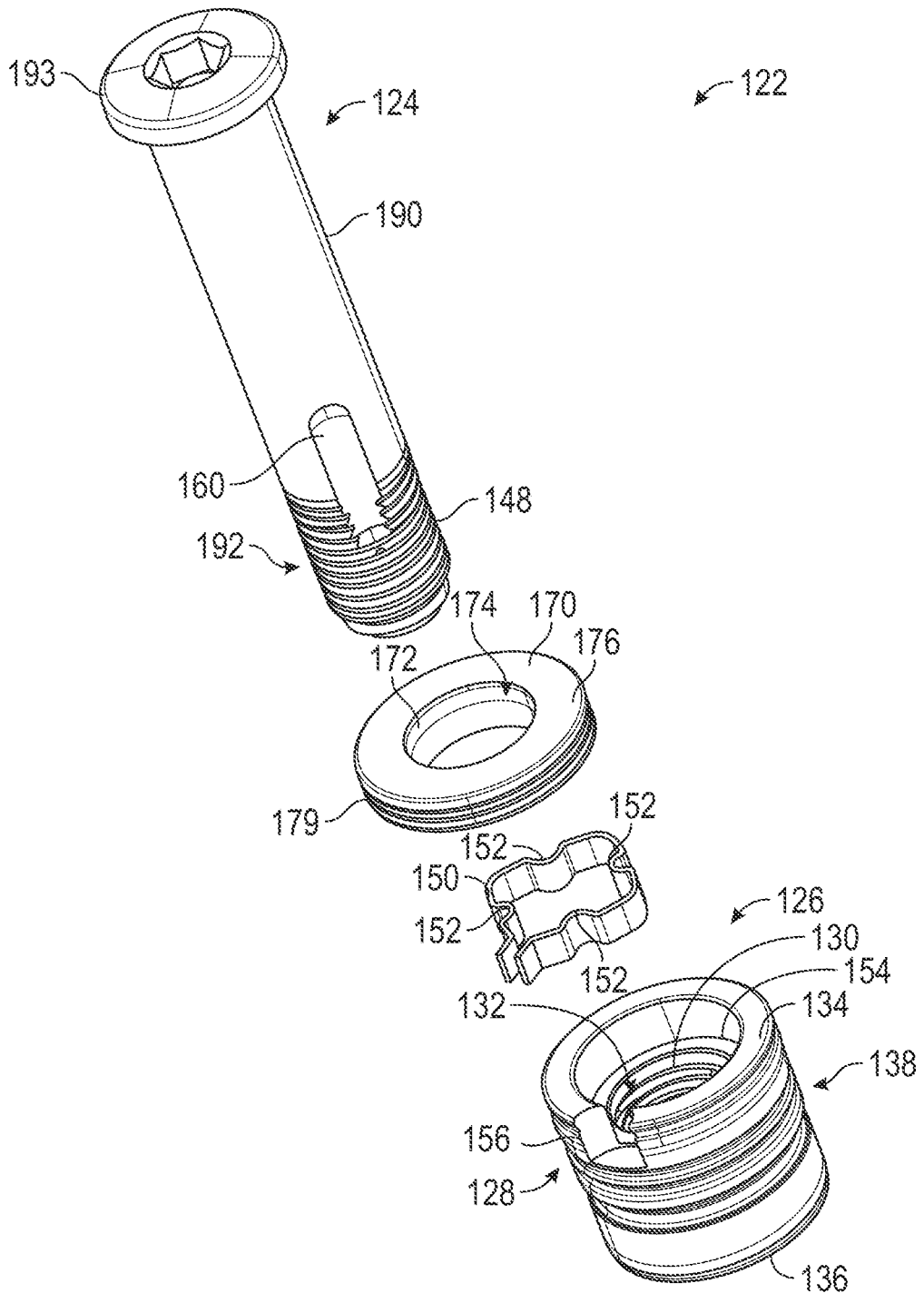
FIG. 7 illustrates an exploded view of an assembly.

FIG. 7 illustrates a configuration of an assembly 122 that may be utilized in examples herein. All or a portion of the assembly 122 may be utilized in examples. The assembly 122 may include a kingpin 124. In examples, the assembly 122 may include a sleeve 126.

The sleeve 126 may include an exterior surface 128, and may include an interior surface 130 that bounds and faces towards an interior channel 132 of the sleeve 126. The interior channel 132 may be configured to receive the kingpin. The sleeve 126 may further include a first end surface 134 and a second end surface 136 (marked in FIG. 10) configured to face opposite the first end surface 134 and being at an opposite end of the sleeve 126. The exterior surface 128 may comprise a radially facing side surface and the axially facing end surfaces 134, 136 may extend between and join the exterior surface 128 and the interior surface 130 in examples. The sleeve 126 may have a cylindrical shape as represented in FIG. 7, or may have other shapes in examples.

Figure 14:
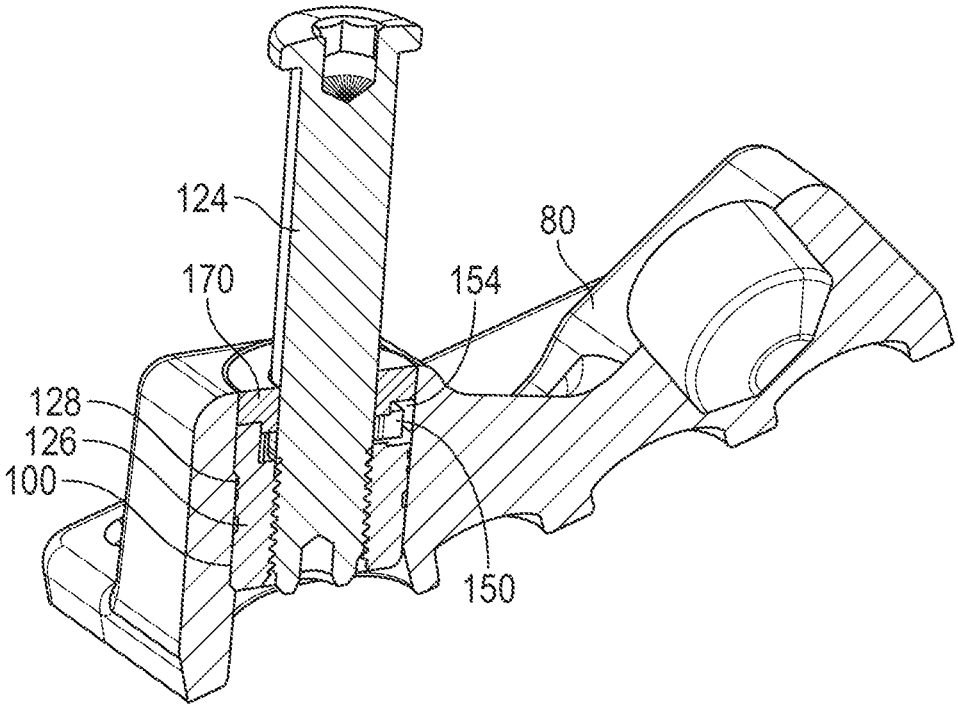
FIG. 14 illustrates a perspective cross sectional view of the baseplate of the truck including the assembly shown in FIG. 7.
Figure 15:
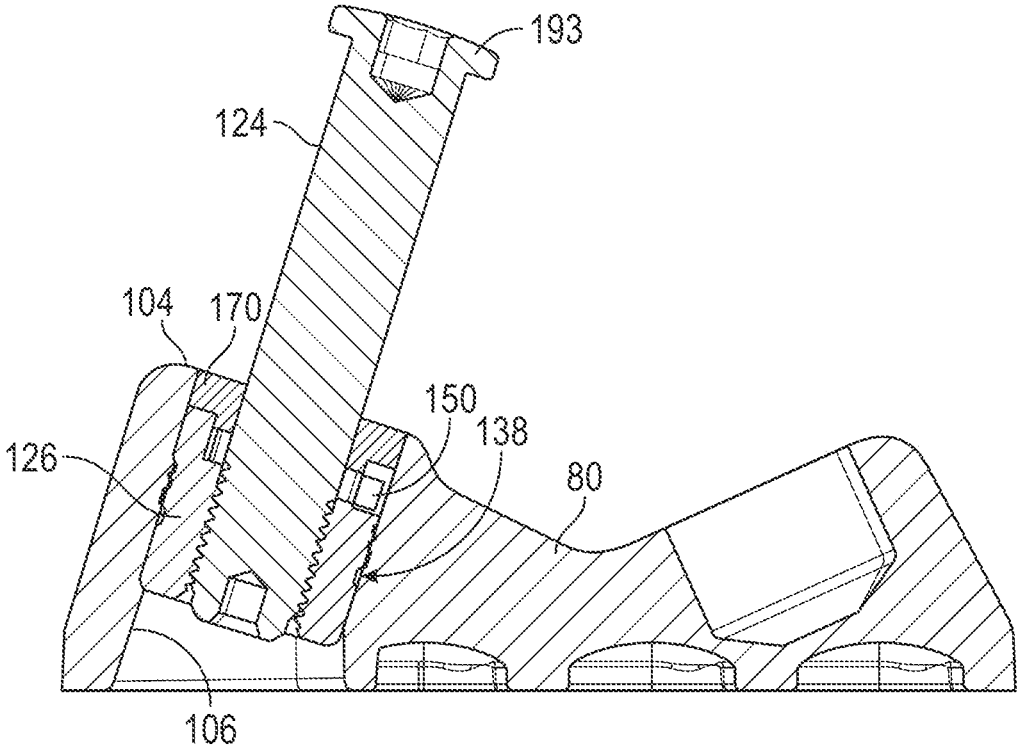
FIG. 15 illustrates a side cross sectional view of the baseplate of the truck including the assembly shown in FIG. 7.

The sleeve 126 may be configured to extend within the aperture 98 of the baseplate 80 for example as represented in FIGS. 14 and 15. The sleeve 126 may comprise an insert or insert body that is inserted into the aperture 98, and may be utilized to increase the hardness of the channel formed through the baseplate 80 that receives the kingpin. A reduced possibility of damage to the baseplate (e.g., deformation, ovalization) through use of the skateboard accordingly may result. Improved retention of the kingpin and use of the skateboard may result.

Figure 8:
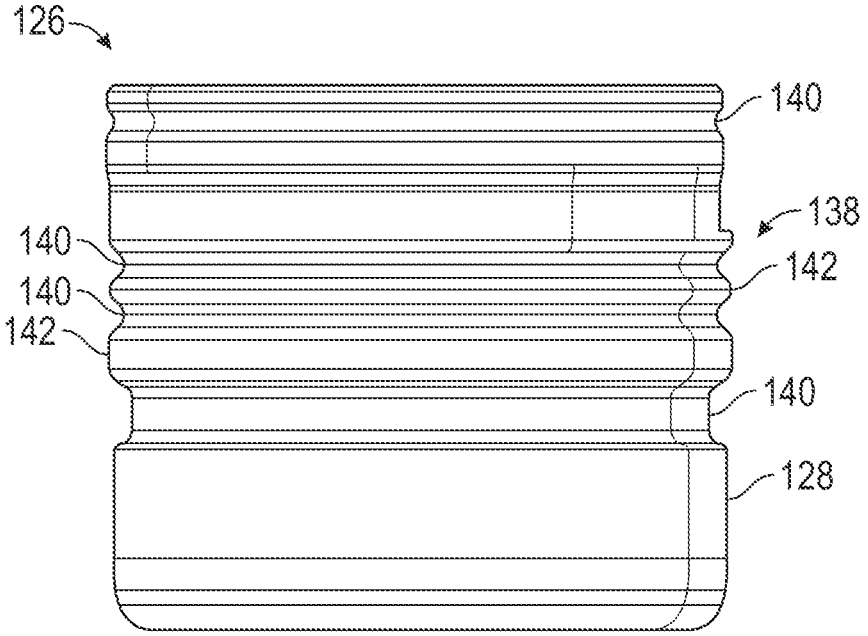
FIG. 8 illustrates a side view of a sleeve shown in FIG. 7.

Referring to FIG. 7, the exterior surface 128 may include one or more engagement features 138 that may be configured to engage the sidewall 100 of the aperture 98. The one or more engagement features 138 may have a variety of forms in examples. The one or more engagement features 138, for example, may comprise a variation in a surface profile of the exterior surface 128, as represented in FIG. 8, for example. The one or more engagement features 138 may increase friction (e.g., may comprise friction elements) with the sidewall 100 to reduce the possibility of axial movement or dislodgement of the sleeve 126 and/or rotational movement of the sleeve 126 within the aperture 98. The one or more engagement features 138, for example, may have the form of one or more grooves 140 and/or ridges 142 in the exterior surface 128, as represented in FIG. 8 for example. The one or more grooves 140 and/or ridges 142 may be spaced from each other axially as represented in FIG. 8. The one or more grooves 140 and/or ridges 142 may extend parallel and circumferentially about the exterior surface 128. The one or more grooves 140 and/or ridges 142 may extend perpendicular to the central axis of the sleeve 126 in examples or at another angle as desired. The one or more engagement features 138 may have the form of knurls or flutes or other variations in surface profile of the exterior surface 128 in examples. Other forms of engagement features are disclosed herein.

The one or more engagement features 138 preferably increase retention of the sleeve 126 within the aperture 98 such that a force of use upon the truck and/or a kingpin (or kingpin fastener) does not dislodge the sleeve 126 from the aperture 98. Thus, as a user performs skateboard tricks or otherwise exerts force against a portion of the truck, the sleeve 126 preferably remains stable within the aperture 98.

The one or more engagement features 138 may engage the sidewall 100 of the aperture 98 with a press fit or interference fit. Upon the sleeve 126 being inserted into the aperture 98 (e.g., with relatively high force in an assembly process), the material of the sidewall 100 may expand slightly radially outward to accommodate the insertion of the sleeve 126 and then remain locked or otherwise engaged with the sleeve 126 by gripping onto the one or more engagement features 138. For example, material of the sidewall 100 may enter into the one or more grooves 140 to grip the sleeve 126 into position. As such, reduced possibility of dislodgement of the sleeve 126 may result.

Other configurations of engagement features may be utilized in examples, which may include other forms of engagement features disclosed herein.

Figure 9:
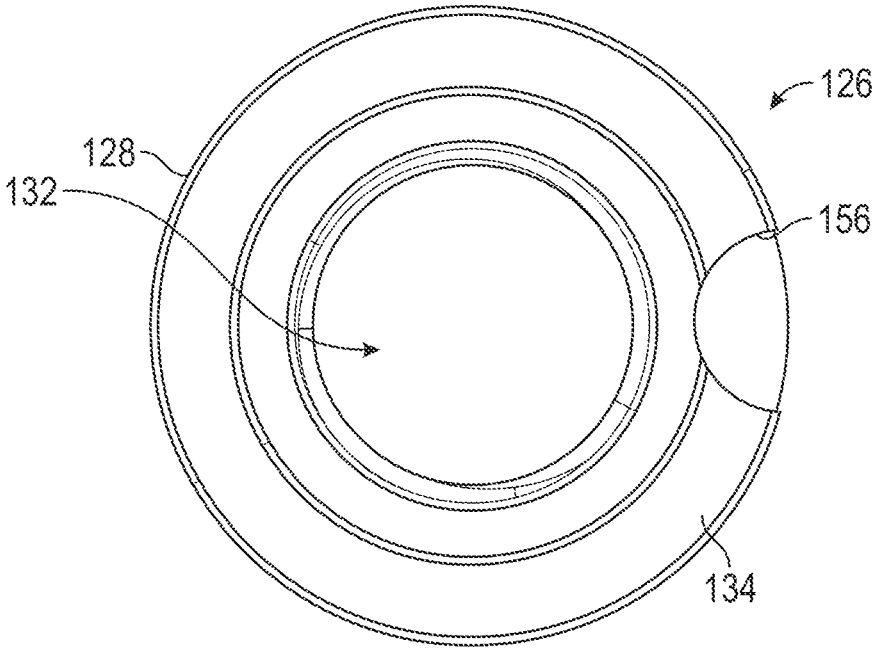
FIG. 9 illustrates an end view of the sleeve shown in FIG. 7.

FIG. 9 illustrates an end view of the sleeve 126 from the first end surface 134. The sleeve 126 may include the interior channel 132 for receiving the kingpin.

Figure 10:
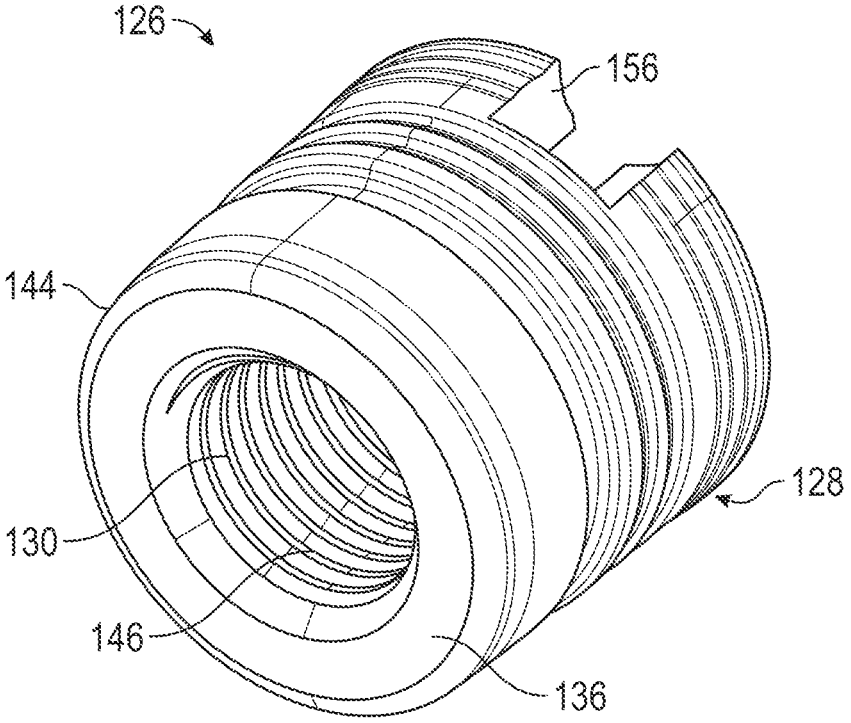
FIG. 10 illustrates an end perspective view of the sleeve shown in FIG. 7.

FIG. 10 illustrates a perspective end view of the sleeve 126 from the second end surface 136. As shown in FIG. 10, a transition 144 between the exterior surface 128 and the second end surface 136 may comprise a tapered or curved transition. Such a transition may enhance an ease of press fit insertion of the sleeve 126 into the aperture 98 with the second end surface 136 leading the insertion in examples.

The interior surface 130 of the sleeve 126 may further comprising an engagement surface in the form of threading 146 in examples. The threading 146 may be configured to engage corresponding threading 148 (marked in FIG. 7) on the kingpin. In examples, the interior surface 130 may be smooth or otherwise lack an engagement surface and a fastener may be utilized to secure the kingpin in position.

Other configurations of sleeves may be utilized in examples.

Referring back to FIG. 7, in examples, the assembly 122 may include a retainer 150 for engaging the kingpin 124 within the interior of the aperture 98. The retainer 150 may be utilized solely or in combination with other features disclosed herein. The retainer 150 may include one or more protrusions 152 that extend radially inward for contacting the kingpin 124. The retainer 150 may comprise a clip (as represented in FIG. 7) or may have another configuration in examples. The clip may comprise a strip of material contoured to form multiple protrusions 152 as shown in FIG. 7, or may have another configuration in examples (e.g., pins, detents, latches, among other forms of retainers). The clip or protrusions 152 may comprise a spring that may be spring biased towards the kingpin 124 in examples.

In examples, the sleeve 126 may receive the retainer 150. For example, the sleeve 126 may include a recess 154 for receiving the retainer 150 (as marked in FIG. 7). The interior surface 130 of the sleeve 126 may include the recess 154. The recess 154 may comprise an annular recess in the interior surface 130 or may have another configuration as desired. In examples, an opening 156 in the exterior surface 128 of the sleeve 126 may receive a portion of the retainer 150 (e.g, an end, or tang, or radially outward protruding portion of the retainer). The retainer 150 may engage the opening 156 to reduce the possibility of the retainer 150 rotating within the recess 154 of the sleeve 126.

In examples, the protrusions 152 may be compliant and configured to deflect to allow the kingpin 124 to rotate within the sleeve 126 at a desired time (e.g., during removal or insertion of the kingpin). The protrusions 152, for example, may be made of a compliant metal or otherwise may be movable or deformable (e.g., spring biased), to allow for rotation of the kingpin 124. The kingpin 124, for example, may include a channel 160 extending along the longitudinal axis of the kingpin 124 for receiving a protrusion 152 and selective engagement with one of the protrusions 152 when the kingpin 124 is rotated within the sleeve 126. The protrusions 152 may engage the channel 160 to reduce the possibility of undesired rotation of the kingpin 124 relative to the sleeve 126. The protrusions 152 may deflect radially outward to allow for release of the kingpin from the sleeve 126 upon rotation (e.g., unscrewing) of the kingpin relative to the sleeve 126.

Other configurations may be utilized in examples. In examples, the use of the retainer 150 may be excluded.

The assembly 122 may include a securement ring 170 in examples. The securement ring 170, for example, may be utilized to secure the retainer 150 within the interior of the aperture 98. The securement ring 170 may include an interior surface 172 facing an interior channel 174 of the securement ring 170 in examples. The interior channel 174 may receive the kingpin. The securement ring 170 may include an end surface 176 and an opposite end surface 178 (marked in FIG. 11) that may include a lip 180 for aligning the securement ring 170 relative to the sleeve 126. The securement ring 170 may include an exterior surface 179 facing opposite the interior surface 172.

Figure 11:
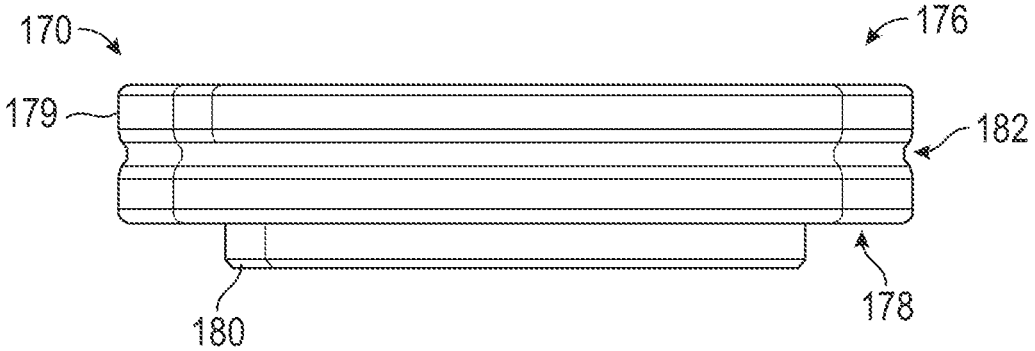
FIG. 11 illustrates a side view of the securement ring shown in FIG. 7.

Referring to FIG. 11, the exterior surface 179 of the securement ring 170 may include one or more engagement features 182 (e.g., grooves or other forms of engagement features disclosed herein). The exterior surface 179 may be a side surface extending between axially facing end surfaces 176, 178. The engagement features 182 may engage the sidewall 100 of the aperture 98 in a similar manner as the engagement features of the sleeve 126. The engagement features 182 may reduce the possibility of the securement ring 170 being dislodged when the securement ring 170 extends within the aperture 98.

In assembly, the securement ring 170 may cover or otherwise secure the retainer 150 within the aperture 98. The securement ring 170 may be inserted over the retainer 150 positioned within the recess 154. In examples, the securement ring 170 may have an outer diameter that is the same as the outer diameter of the sleeve 126. In examples, the securement ring 170 may have an inner diameter that is the same as the inner diameter of the sleeve 126 (e.g., the diameter of the channels formed by the sleeve 126 and the securement ring 170 for receiving the kingpin). Other diameters may be utilized in examples.

In examples, the use of the securement ring 170 may be excluded or other forms of securement of the retainer 150 may be utilized.

The kingpin 124 of the assembly 122 may include an elongate shaft 190 or bolt body for insertion within the channels of the sleeve 126 and the securement ring 170. The shaft 190 may include the threading 148 along its length, and at a distal end portion 192 of the shaft 190 relative to the head 193. A proximal portion of the shaft 190 may be smooth and may lack threading in examples. The head 193 may comprise a portion of the kingpin 124 having a larger diameter than the shaft 190. The head 193 may be sized to have a larger diameter than the inner diameter of the sleeve 126 and the securement ring 170 in examples. Other forms of kingpins may be utilized in examples.

FIGS. 12 and 13 illustrate components of the assembly 122 coupled to the baseplate 80. The shaft 190 is shown to protrude from the baseplate 80 in the top side direction for coupling with bushings and a hanger of the truck. The head 193 is positioned in an "inverted kingpin" configuration. The securement ring 170 is flush or co-planar with the top side support surface 104.

FIG. 13 illustrates an underside view of the baseplate 80, showing the second end surface 136 of the sleeve 126. A tip of the kingpin 124 is shown to protrude from the second end surface 136 of the sleeve 126 within the pocket 108 or recess of the baseplate 80.

FIG. 14 illustrates a perspective cross sectional view of the configuration shown in FIGS. 12 and 13. The exterior surface 128 of the sleeve 126 is shown to engage the sidewall 100 of the aperture 98. The retainer 150 is illustrated within the recess 154 of the sleeve 126, positioned axially between the securement ring 170 and the sleeve 126.

FIG. 15 illustrates a side cross sectional view of the configuration shown in FIGS. 12 and 13. The outer diameter of the sleeve 126 and securement ring 170 is shown to be uniform, and the same as the inner diameter of the aperture 98. The combination of the sleeve 126 and the securement ring 170 accordingly has the profile of a continuous tube (e.g., a cylindrical tube profile) extending within the aperture, and lacking radially protruding flanges. The sleeve 126 and securement ring 170 may each have a uniform outer and inner diameter from end to end of the respective sleeve 126 and securement ring 170 and may lack flanges. The sleeve 126 extends for only a portion of the length of the aperture 98, yet the assembly or combination of the sleeve 126 and the securement ring 170 extends for the entirety of the length of the aperture 98. In examples, the assembly or combination of the sleeve 126 and the securement ring 170 may extend for only a portion of the length of the aperture 98.

In assembly, the sleeve 126 may be inserted into the aperture 98 of the baseplate 80 with a press fit. The engagement features 138 of the sleeve 126 may engage the sidewall 100 upon insertion. The retainer 150 may then be inserted into the aperture 98. The securement ring 170 may be positioned over the retainer 150 and may extend within the aperture 98.

At a desired time, the kingpin 124 may be inserted through the sleeve 126. The kingpin 124 may engage the threading of the sleeve 126, or in examples, a fastener may be utilized. The kingpin 124 may be in an "inverted kingpin" configuration or other configurations may be utilized in examples (e.g., a "non-inverted kingpin."). In the "inverted kingpin" configuration, the head 193 of the kingpin 124 is positioned with the top side support surface 104 disposed intermediate the head 193 and the deck 12. In a "non-inverted kingpin" configuration, the head 193 would be positioned between the underside support surface 106 and the deck 12.

The hardness of the sleeve 126 and/or securement ring 170 (including the engagement portions) is preferably greater than the material of the sidewall 100 of the aperture 98. The hardness of the sleeve 126 and/or securement ring 170 (including the engagement portions) may be harder than the material of the entirety of the baseplate 80. For example, the baseplate 80 may be cast out of a relatively lightweight and soft material such as aluminum, and the sleeve 126 and/or securement ring 170 may be made of a harder material such as steel, iron, alloys of iron, or other materials with greater hardness than the material of the baseplate 80. As such, a reduced possibility of damage and ovalization to the aperture 98 may result. In examples, the hardness may comprise an HRC (Rockwell scale) hardness of between 28-45, although other ranges and materials may be utilized as examples. The hardness of the sleeve 126 may further allow for features such as threading to be provided on the sleeve 126 and effectively utilized to engage the kingpin.

In examples, other features may be utilized as desired. For example, a collar insert (e.g., a nyloc insert or other form of insert) may be incorporated to increase friction with the kingpin. In examples, the use of the retainer 150 and the securement ring 170 may be excluded and the sleeve 126 may extend flush or coplanar with the top side support surface 104. The sleeve 126 may extend to the underside support surface 106. In examples, one or more flanges may be incorporated with the sleeve 126 and/or the securement ring 170. Features disclosed herein in other examples may be incorporated as desired.

Features disclosed in regard to FIGS. 5-15 may be utilized solely or in combination with any other example disclosed herein.

Figure 16:
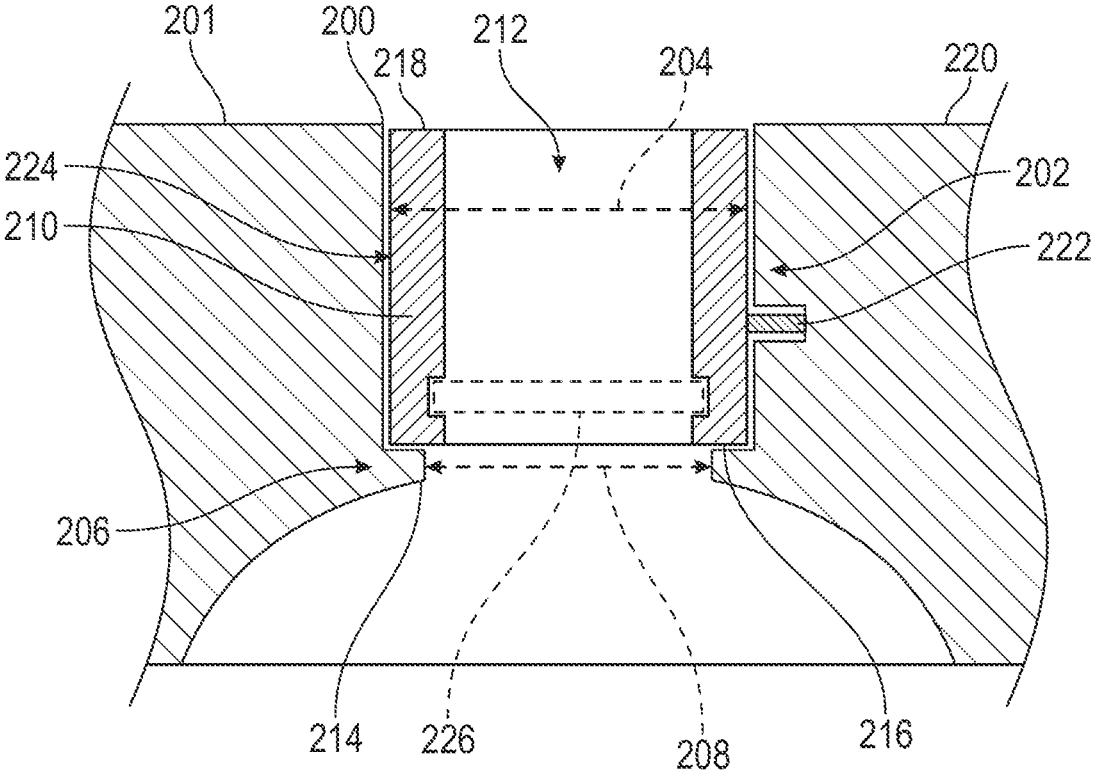
FIG. 16 illustrates a cross sectional view of a sleeve within an aperture of a baseplate.

FIG. 16 illustrates a variation in which the aperture 200 of the baseplate 201 includes a first portion 202 having a first diameter 204 and a second portion 206 having a second diameter 208 that is less than the first diameter 204. The sleeve 210 may extend within the first portion 202 and may include an interior channel 212 for receiving the kingpin, in a similar manner as discussed regarding the interior channel 132 of the sleeve 126.

The transition between the first portion 202 and the second portion 206 may comprise a radially inward extending step 214. The sleeve 210 accordingly may seat upon the radially inward extending step 214, with the axially facing end surface 216 of the sleeve 210 facing towards the radially inward extending step 214. An opposite axially facing end surface 218 of the sleeve 210 may be flush or coplanar with the top side surface 220 of the baseplate, although other configurations (e.g., axially recessed from the top side surface 220) may be utilized.

The radially inward extending step 214 may prevent the sleeve 210 from being pressed in an axial direction towards the deck and dislodged from the aperture 200. In examples, a retainer 222 may be utilized that may retain the sleeve 210 within the first portion 202 of the aperture. The retainer 222, for example, may contact the exterior surface 224 of the sleeve 210 to prevent the sleeve 210 from sliding axially within the aperture 200 in a direction opposite from (axially away from) the radially inward extending step 214. The retainer 222, for example, may comprise a pin or other form of retainer that protrudes radially inward to contact the sleeve 210. The retainer 222 may protrude radially inward from the sidewall of the aperture and may engage the radially outward facing exterior surface 224 or side surface of the sleeve 210.

Various other modifications may be made. For example, the interior channel 212 of the sleeve 210 may be smooth and a fastener may be utilized to secure the kingpin in position. In examples, the interior channel 212 may include an engagement surface such as threading for engaging the kingpin. In examples, a collar insert 226 (marked in dashed lines) may be included for increasing friction with the kingpin. An exterior surface 224 of the sleeve 210 may include one or more engagement features as disclosed herein. In examples, one or more flanges may be utilized as desired.

Figure 18:
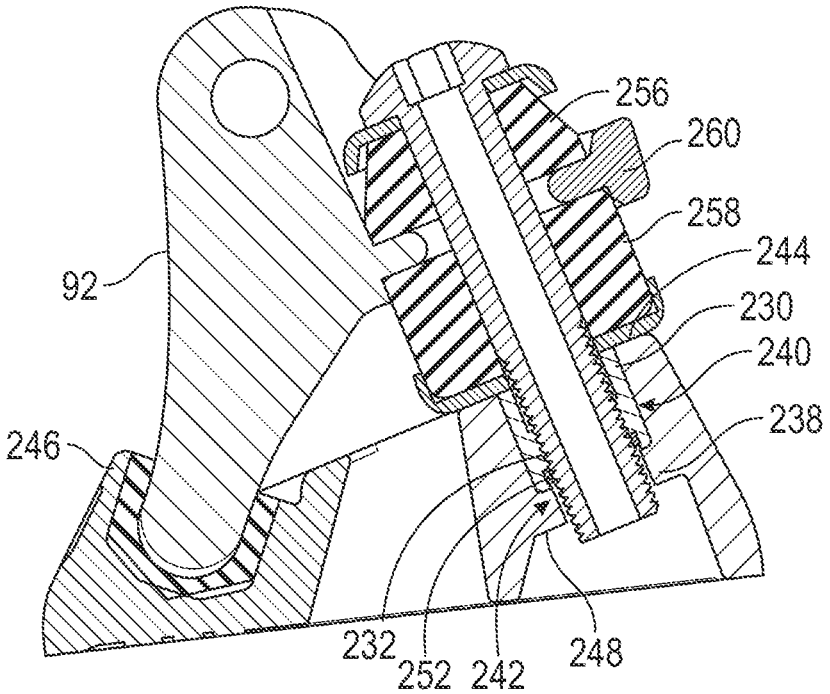
FIG. 18 illustrates a side cross sectional view of the sleeve within the aperture of the baseplate shown in FIG. 17.

FIGS. 17 and 18, for example, illustrate an implementation of a sleeve having certain features as represented in FIG. 16, yet in which a sleeve 230 has an interior surface including threading 232 (shown in the close up view of FIG. 34L) for engaging the kingpin 234. Features as disclosed in regard to FIG. 16 may be utilized unless stated otherwise. The aperture 236 is configured similarly as the aperture 200 shown in FIG. 16 and includes a portion having a lesser diameter than another portion of the aperture 236. A radially inward extending step 238 results that the sleeve 230 seats upon.

As shown in FIG. 18, the portion 240 of the aperture 236 having the greater diameter is disposed intermediate the portion 242 having the lesser diameter and the top side support surface 244 of the baseplate 246. In examples, the configuration may be inverted, with the portion having the lesser diameter being positioned at the top side support surface 244 and the portion with the greater diameter being positioned at the underside support surface 248.

The portions 240, 242 may have cylindrical shapes with uniform diameters, or other shapes may be utilized in examples. The radially inward extending step 238 may comprise a perpendicular surface extending relative to the sidewalls of the portions 240, 242 or may have another shape in examples. The sleeve 230 may have a cylindrical shape with a uniform outer diameter from end to end, although other shapes may be utilized as desired.

The threading 232 of the sleeve 230 may exclude the need for a fastener, although in examples, a fastener may be utilized (as represented in FIGS. 23-29 and 31-32 for example).

Figure 34A:
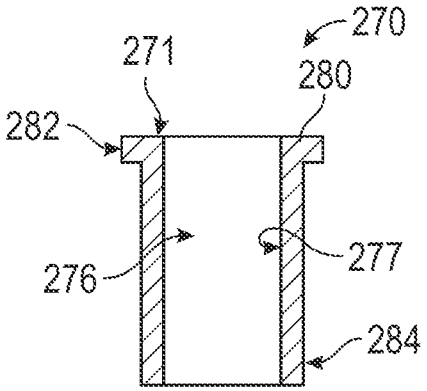
FIGS. 34A-34M each illustrate a side cross sectional view of a sleeve.
Figure 34B:
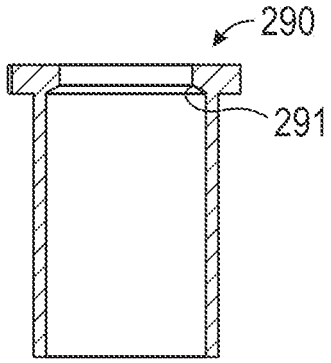
Figure 34C:
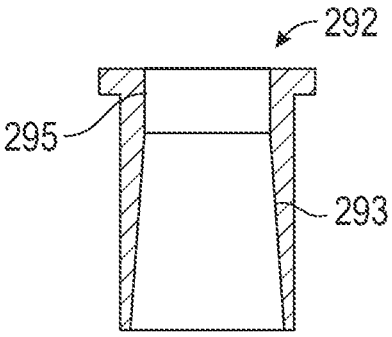
Figure 34D:
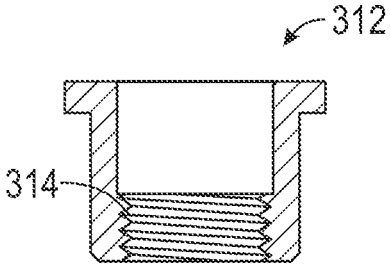
Figure 34E:
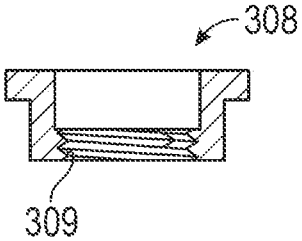
Figure 34F:
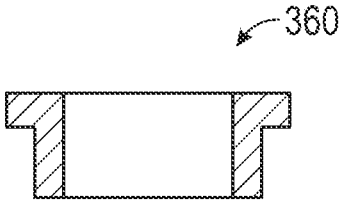
Figure 34G:
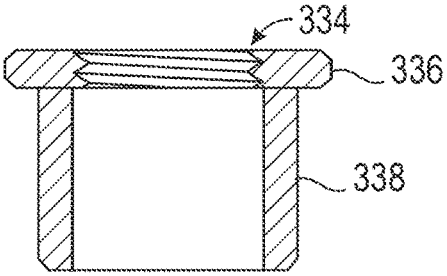
Figure 34H:
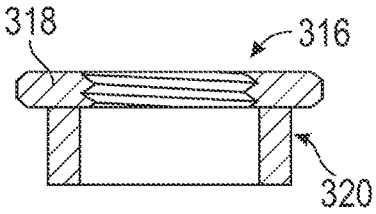
Figure 34I:
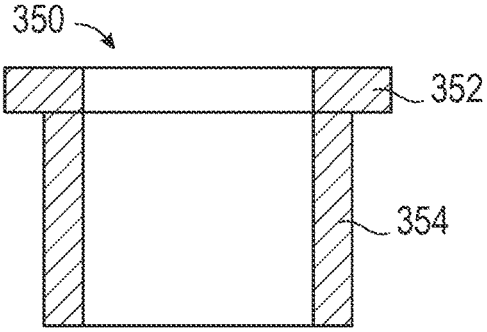
Figure 34J:
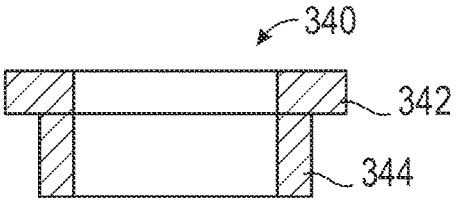
Figure 34K:
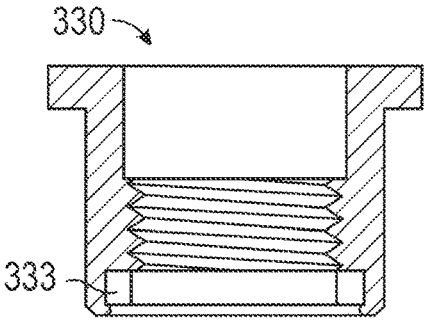
Figure 34L:
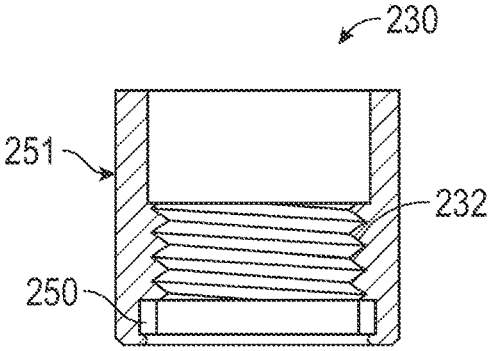

FIG. 34L illustrates a close up view of the sleeve 230. The sleeve 230 may include a recess 250 for receiving a collar insert 252 (e.g., a nyloc insert or other form of insert) for increasing friction with the kingpin. An exterior surface 251 of the sleeve 230 may include one or more engagement features as disclosed herein.

FIGS. 17 and 18 further illustrate features that may be utilized with any example herein. The hanger 94 of a truck is shown, with an axle 254 extending from the hanger 94. The pivot arm 92 extends to the pivot cup 90, and the kingpin 234 is coupled to the bushings (i.e., a top bushing 256 and a bottom bushing 258 that is supported by the top side support surface 244). The kingpin 234 is coupled to a loop 260 of the hanger 94. The kingpin 234 is shown in an "inverted kingpin" configuration in FIGS. 17 and 18, although a "non-inverted kingpin" configuration may be utilized in examples.

Features disclosed in regard to FIGS. 16-18 may be utilized solely or in combination with any other example disclosed herein. The sleeves disclosed in regard to FIGS. 16-18 may have a hardness and may thus provide for improved anchoring of the kingpin, in a similar manner as disclosed in regard to FIGS. 5-15.

In examples, a sleeve may be utilized that comprises a flanged sleeve. The use of a flange may enhance the securement of the sleeve within the baseplate aperture and further reduce the possibility of dislodgement of the sleeve from the aperture. Referring to FIG. 19, for example, a perspective cross sectional view of a "non-inverted kingpin" configuration is illustrated, showing a flanged sleeve 270. The flanged sleeve 270 may extend within the aperture 272 of the baseplate 274 and may include an interior channel 276 for receiving the kingpin 278, similar to other examples of sleeves disclosed herein.

FIG. 34A illustrates a side cross sectional view of the flanged sleeve 270. The sleeve 270 is shown to include an interior surface 277 that faces towards the interior channel 276. The interior surface 277 may be smooth or may include threading for engaging the kingpin in examples.

The flange 280 may be positioned at an end portion of the sleeve 270, such as a top side end portion 282. In examples, the position of the flange 280 may be at the other end portion or underside end portion 284 as desired.

Figure 20:
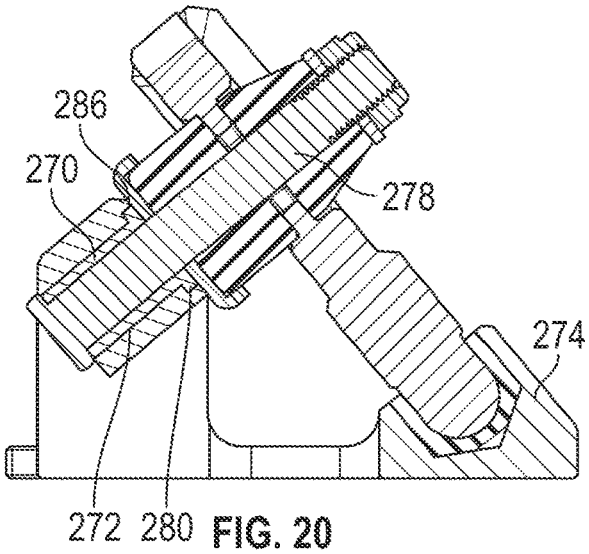
FIGS. 20-33 each illustrate a side cross sectional view of a sleeve within an aperture of a baseplate.

FIG. 20 illustrates a side cross sectional view of the configuration shown in FIG. 19. The kingpin 278 is shown seated within the flanged sleeve 270. The aperture 272 may comprise a stepped aperture, with the step provided at the top side support surface 286 of the baseplate 274. The flange 280 may be positioned at the top side support surface 286. An axially facing end surface 271 of the sleeve 270 may be flush or coplanar with the top side support surface 286, although other configurations may be utilized (e.g., axially recessed from the top side support surface 286). The sleeve 270 may extend for the length of the aperture 272 or a lesser length may be provided as desired. The sleeve 270 outer dimensions may match the inner dimensions of the aperture 272.

Figure 21:
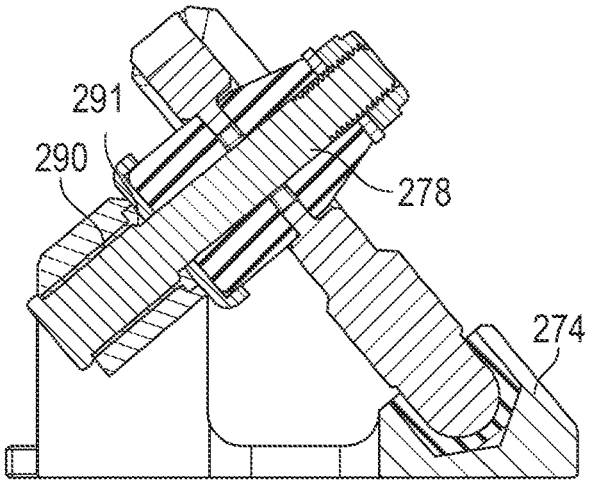

FIG. 21 illustrates a variation of the sleeve 270, in which the sleeve 290 includes a tapered interior surface 291. FIG. 34B illustrates a side cross sectional view of the sleeve 290.

In examples featuring the more common (non-inverted) kingpin orientation (with the kingpin pressed into the baseplate from the underside), superior kingpin stiffness and press-fit stability is achieved via adding a taper or step to the interior diameter of the flanged sleeve, with a matching taper or step added to a thickened exterior diameter of the interfacing portion of the kingpin. Optional thread-lock between the interior of the sleeve and the exterior of the kingpin in the non-inverted orientation may enhance stiffness and stability, with or without taper or step.

Figure 22:
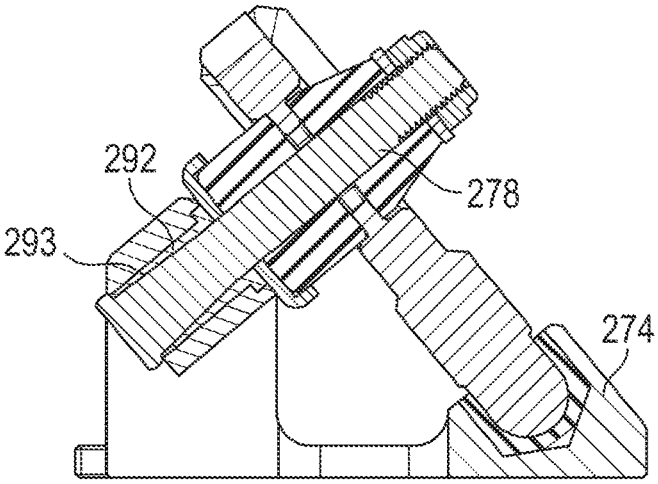

FIG. 22 illustrates a variation of the sleeve 270, in which the sleeve 292 has a tapered interior surface 293 that extends for a majority of the length of the sleeve 292. FIG. 34B illustrates a side cross sectional view of the sleeve 292. A non-tapered portion 295 of the interior surface may be provided in examples.

Figure 23:
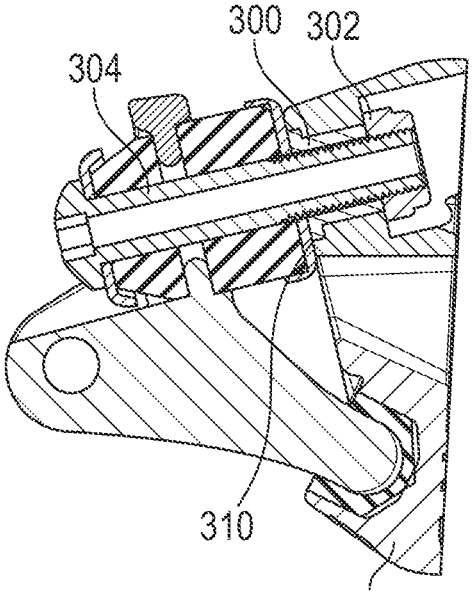

FIGS. 23-33 illustrate variations in an "inverted kingpin" configuration. FIG. 23 illustrates the flanged sleeve 300 having a smooth interior surface. A fastener 302 (e.g., a nut) is utilized to secure the kingpin 304 to the baseplate 306. The flanged sleeve 300 may extend for all or a portion of the length of the aperture 310 of the baseplate 306. FIG. 34A illustrates a representation of the flanged sleeve (which may be the same configuration as the flanged sleeve 270).

Figure 24:
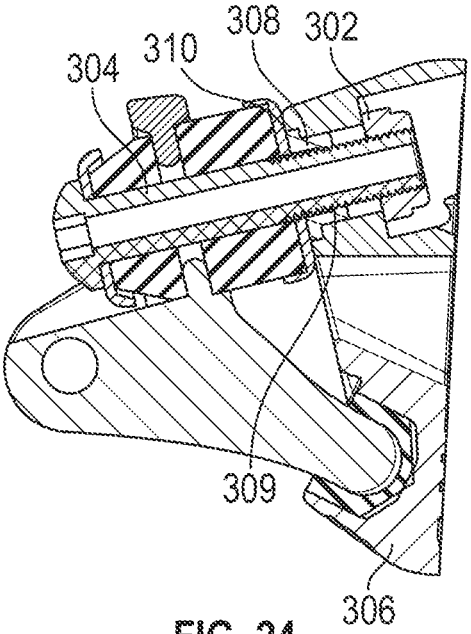

FIG. 24 illustrates a variation in which the interior surface of the flanged sleeve 308 includes threading 309. FIG. 34E illustrates a side cross sectional view of the flanged sleeve 308. The flanged sleeve 308 may extend for a portion of the length of the aperture 310.

Examples may include threading (full or partial) on an interior diameter of a sleeve (e.g., a flanged sleeve), for mating with threading on an exterior diameter of the kingpin. In an inverted orientation, this may further protect the fastener from being dislodged. A thread-lock may mechanically stop the kingpin from pushing the fastener out of its pocket.

Figure 25:
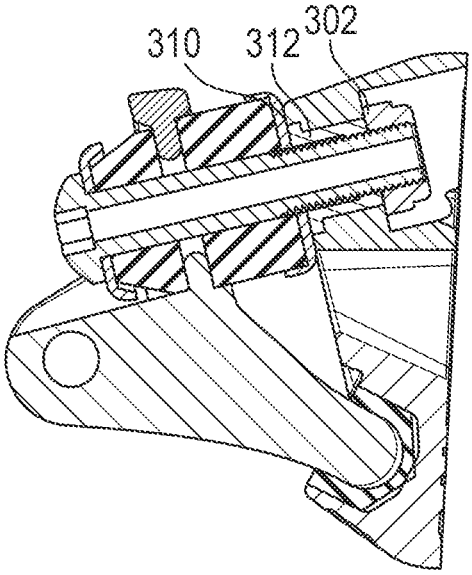

FIG. 25 illustrates a variation in which the interior surface of the flanged sleeve 312 includes threading 314 and the flanged sleeve 312 extends for the length of the aperture 310. FIG. 34D illustrates a side cross sectional view of the flanged sleeve 312.

Figure 26:
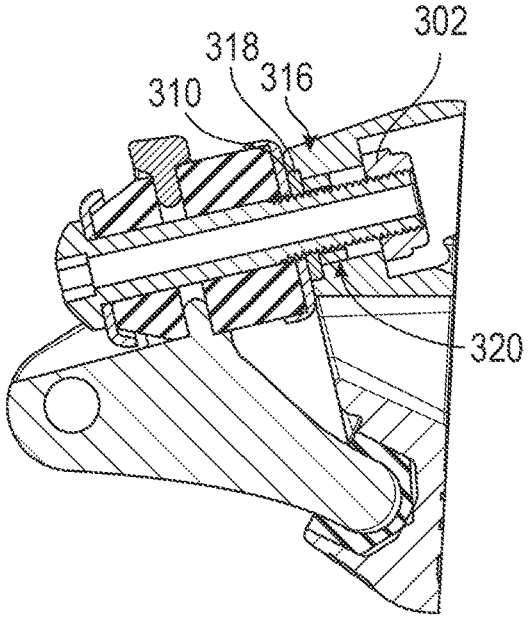

FIG. 26 illustrates a variation in which the flanged sleeve 316 is a multi-part sleeve 316, including a ring or washer 318 flanged portion with threading, and a sleeve portion 320 that has a smooth interior. The flange may be non-integral with the sleeve portion 320. The sleeve portion 320 may extend for a portion of the length of the aperture 310. FIG. 34H illustrates a side cross sectional view of the flanged sleeve 316.

The high-strength flanged sleeve may be split into two parts—a wide washer 318 with interior threading atop a thinner sleeve portion 320 (with or without interior threading), both pressed into a stepped aperture at the top of the baseplate. In such an example, the interior threading on the wide washer 318 creates a thread-lock that mechanically stops the kingpin from dislodging the fastener beneath.

Figure 27:
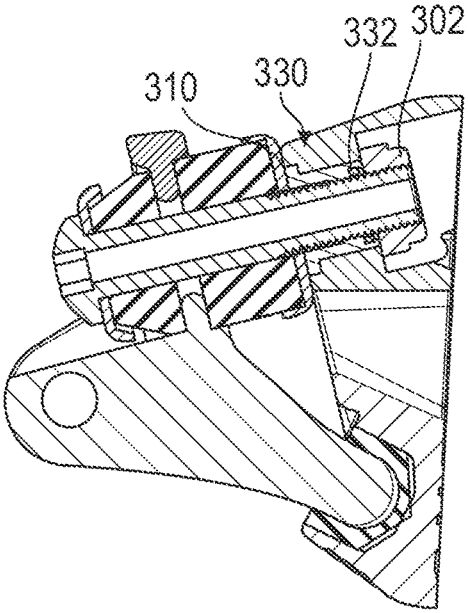

FIG. 27 illustrates a variation in which the interior surface of the flanged sleeve 330 includes interior threading and includes a collar insert 332 (e.g., a nyloc insert or other form of insert) for increasing friction with the kingpin. FIG. 34K illustrates a side cross sectional view of the flanged sleeve 330. The flanged sleeve 300 may include a recess 333 for receiving the collar insert 332.

Figure 28:
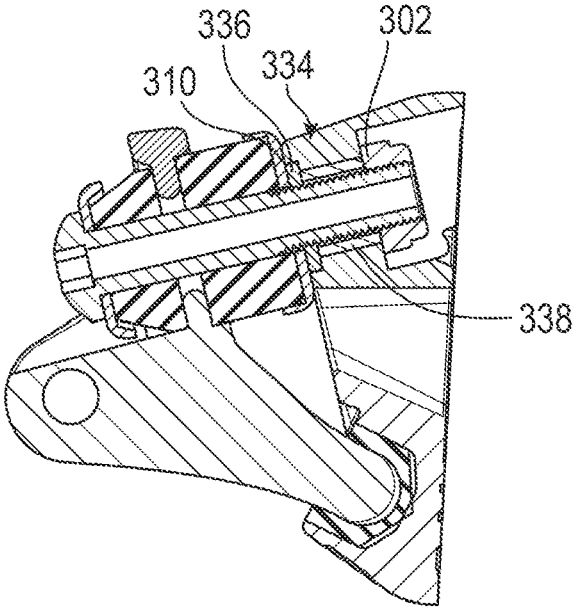

FIG. 28 illustrates a variation in which the flanged sleeve 334 is a multi-part sleeve 334, including a ring or washer 336 flanged portion with threading, and a sleeve portion 338 that has a smooth interior. The flange may be non-integral with the sleeve portion 338. The sleeve portion 338 may extend the length of the aperture 310. FIG. 34G illustrates a side cross sectional view of the flanged sleeve 334.

Figure 29:
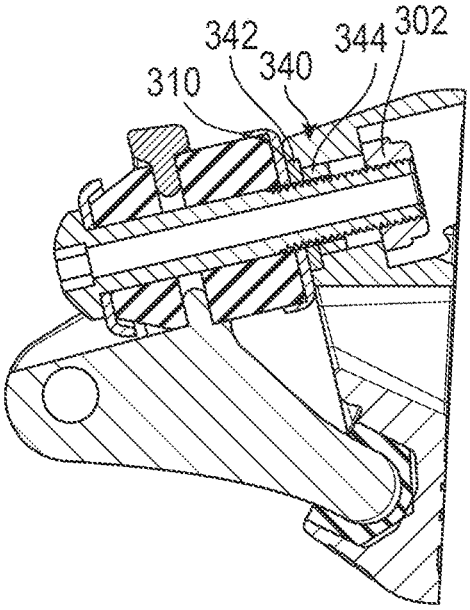

FIG. 29 illustrates a variation in which the flanged sleeve 340 is a multi-part sleeve 340, including a ring or washer 342 flanged portion with a smooth non-threaded interior, and a sleeve portion 344 that has a smooth interior. The ring or washer 342 flanged portion may be non-integral with the sleeve portion 344. FIG. 34J illustrates a side cross sectional view of the flanged sleeve 340.

Figure 30:
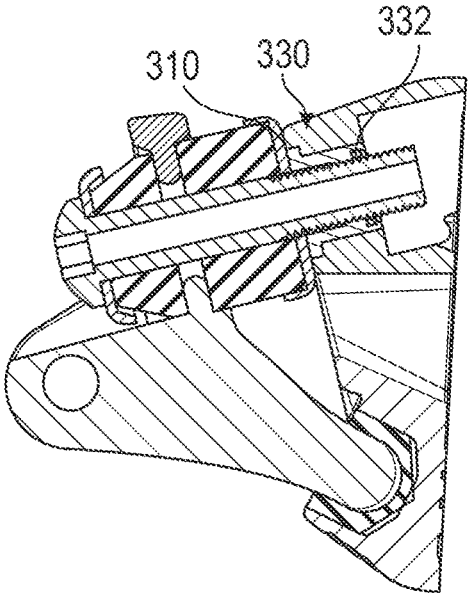

FIG. 30 illustrates a configuration similar to the configuration of FIG. 27, yet without use of a fastener.

The flanged sleeve incorporates a collar insert 332 (e.g., a nylon lock insert) at the bottom of the flanged sleeve (without compromising steel quality) so that no fastener (e.g., locknut) is required beneath it. This frees up space at the bottom of the baseplate and thereby permits a shorter baseplate design, which in turn permits a truck assembly with a lower axle height (desirable for certain skateboarding styles) and a shorter kingpin (which reduces weight).

Figure 31:
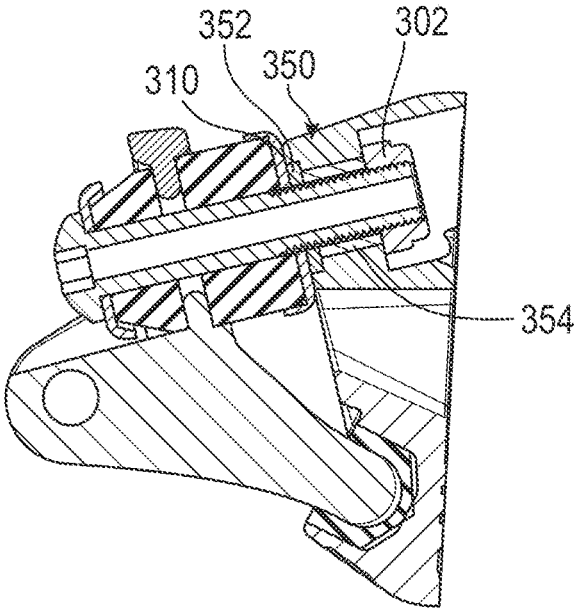

FIG. 31 illustrates a variation in which the flanged sleeve 350 is a multi-part sleeve 350, including a ring or washer 352 flanged portion with a smooth non-threaded interior, and a sleeve portion 354 that has a smooth non-threaded interior. The flange (e.g., ring or washer 352 flanged portion) may be non-integral with the sleeve portion 354. The sleeve portion 354 may extend the length of the aperture 310. FIG. 34I illustrates a side cross sectional view of the flanged sleeve 350.

Figure 32:
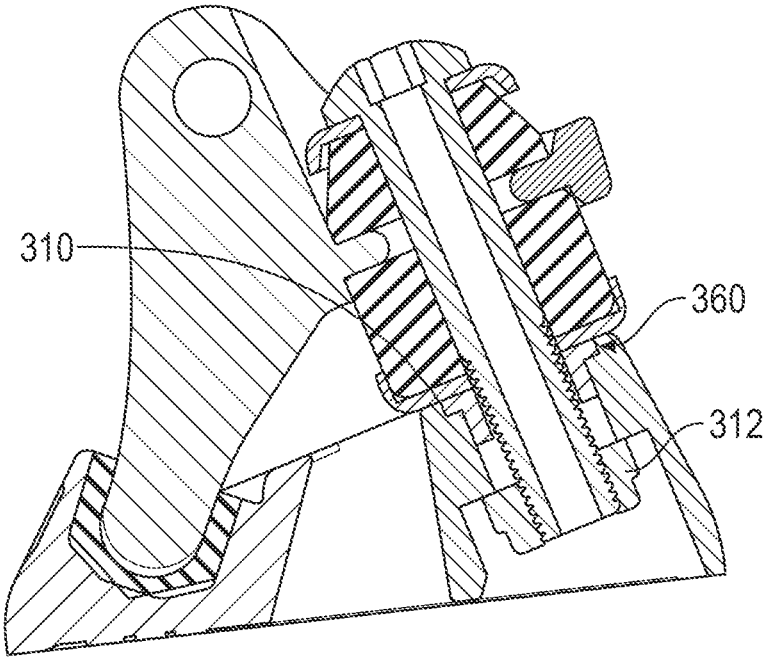

FIG. 32 illustrates a variation in which the flanged sleeve 360 extends for a portion of the length of the aperture 310. The flanged sleeve 360 has a smooth interior surface. FIG. 34F illustrates a side cross sectional view of the flanged sleeve 360.

Figure 33:
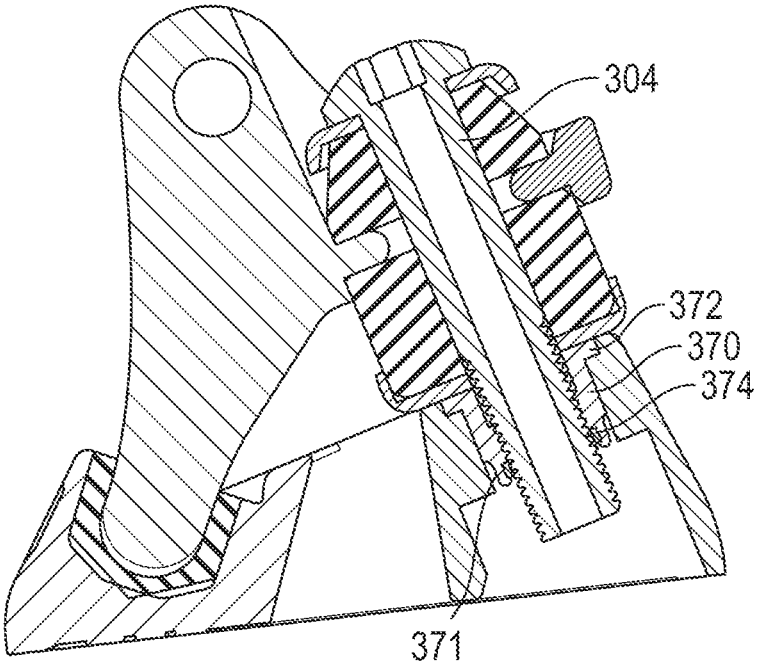
Figure 34M:
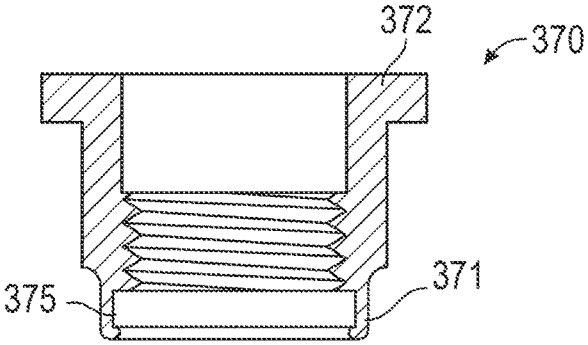
Figure 35A:
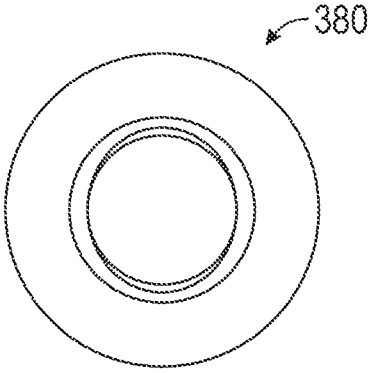
FIG. 35A illustrates an end view of a sleeve.
Figure 35B:
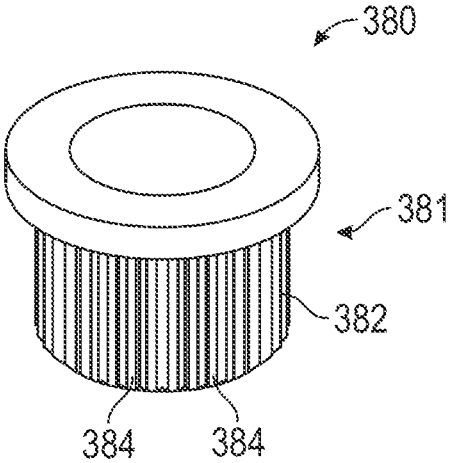
FIG. 35B illustrates a perspective view of the sleeve shown in FIG. 35A.
Figure 35C:
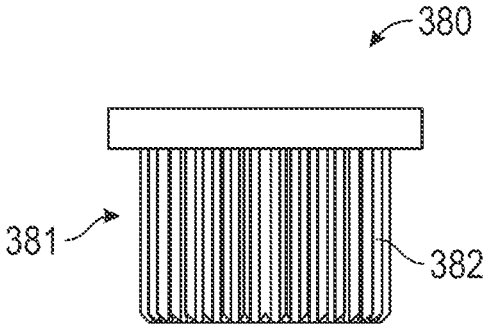
FIG. 35C illustrates a side view of the sleeve shown in FIG. 35A.
Figure 35D:
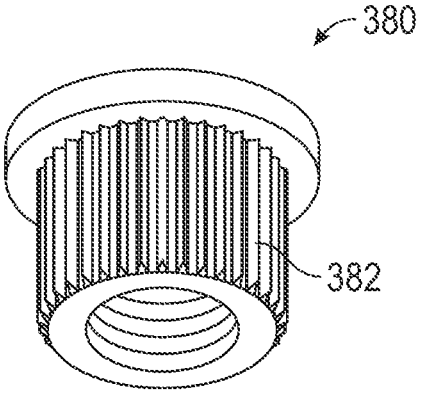
FIG. 35D illustrates a lower perspective view of the sleeve shown in FIG. 35A.
Figure 35E:
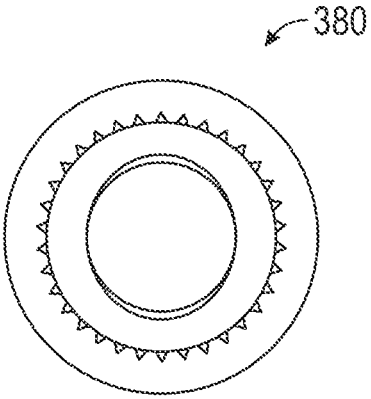
FIG. 35E illustrates an end view of the sleeve shown in FIG. 35A at an opposite end than shown in FIG. 35A.

FIG. 33 illustrates a variation in which the flanged sleeve 370 has an exterior surface 371 that tapers radially inward at the portion of the sleeve 370 opposite the flange 372. The flanged sleeve 370 may include threading for engaging the kingpin. The flanged sleeve 370 may include a collar insert 374 (e.g., a nyloc insert or other form of insert) for increasing friction with the kingpin. FIG. 34M illustrates a side cross sectional view of the flanged sleeve 370, showing a recess 375 for receiving the collar insert 374.

Any of the examples disclosed herein may include one or more engagement features (e.g., grooves or other forms of engagement features disclosed herein) for engagement with the aperture. Referring to FIGS. 35A-35D, an exterior surface of a flanged sleeve 380 is illustrated, showing engagement features 381 in the form of ridges 382 and grooves 384, each extending vertically or axially. The engagement features 381 may comprise fluting along the length of the flanged sleeve, or other forms (e.g., knurls) may be utilized as desired.

Figure 36:
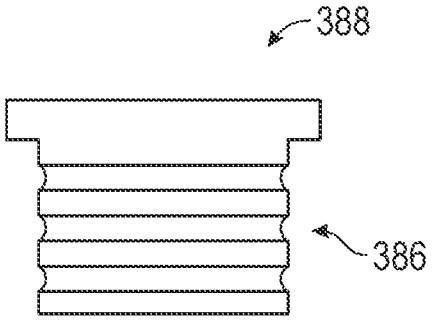
FIGS. 36-38 each illustrate side views of a sleeve.
Figure 37:
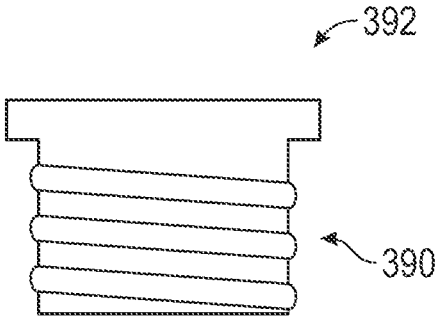
Figure 38:
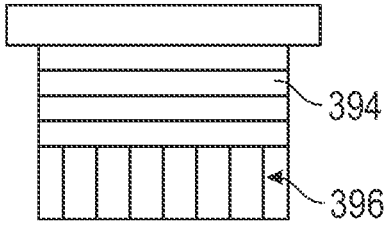

FIG. 36 illustrates a variation of the engagement features in the form of grooves 386 extending circumferentially about the flanged sleeve 388 and spaced from each other axially. FIG. 37 illustrates a variation of engagement features in the form of spiral ridges 390 extending circumferentially about the flanged sleeve 392 and spaced from each other axially. The ridges 390 may form a spiral as desired or may form a horizontal pattern as shown in FIG. 36 for example. FIG. 38 illustrates a variation in which the engagement features include horizontally or circumferentially extending ridges 394 and vertically or axially extending ridges 396 in combination. Various other forms of engagement features may be utilized as desired.

Features disclosed in regard to FIGS. 19-38 may be utilized solely or in combination with any other example disclosed herein. The sleeves disclosed in regard to FIGS. 19-38 may have a hardness and may thus provide for improved anchoring of the kingpin, in a similar manner as disclosed in regard to FIGS. 5-15. A stepped aperture is shown in a top side support surface, yet a configuration may be inverted with a stepped aperture at an underside support surface (with the flange at the underside support surface in examples). Other configurations (e.g., multiple flanges) may be utilized as desired. Other features as disclosed herein may be incorporated and utilized.

Figure 39A:
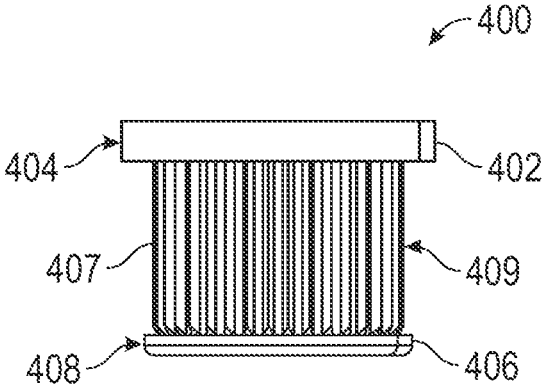
FIG. 39A illustrates a side view of a sleeve.

Referring to FIG. 39A, in examples, a configuration of flanged sleeve 400 may be utilized in which the flanged sleeve 400 has a first flange 402 positioned at a first end portion 404 of the flanged sleeve 400, and a second flange 406 positioned at a second end portion 408 of the flanged sleeve 400 that is opposite the first end portion 404. As such, multiple flanges may be provided for the flanged sleeve 400. A central shaft 407 may be positioned between the flanges 402, 406. The central shaft 407 may have a uniform outer diameter between the flanges 402, 406 and may be cylindrical, although other configurations may be utilized in examples. The flanges 402, 406 may be integral with the central shaft 407 or in other examples as disclosed herein may be non-integral. The flanged sleeve may otherwise be configured similarly as any other example of sleeve as disclosed herein. For example, referring to FIG. 39A, one or more engagement features 409 may be provided, in a similar manner as any other example of engagement feature disclosed herein (e.g., vertical fluting or ridges, or another configuration as desired).

Figure 39B:
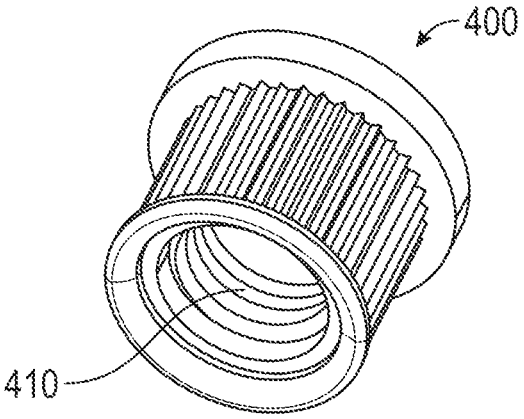
FIG. 39B illustrates a perspective view of the sleeve shown in FIG. 39A.
Figure 39C:
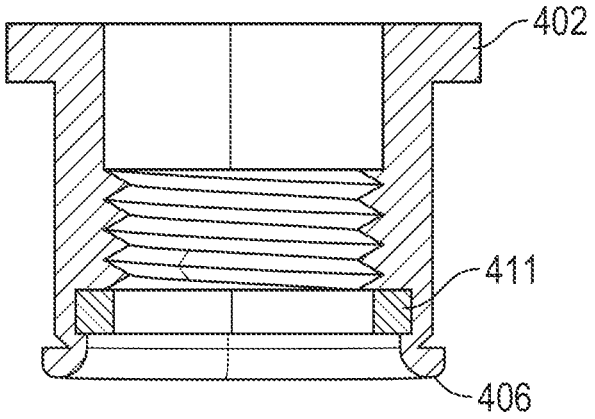
FIG. 39C illustrates a cross sectional view of the sleeve shown in FIG. 39A.

FIG. 39B illustrates a perspective view of the flanged sleeve 400 shown in FIG. 39A. The flanged sleeve 400 may include an interior surface having threading 410, or may have a smooth interior surface in examples. Referring to the cross sectional view of FIG. 39C, a collar insert 411 (e.g., a nyloc insert or other form of insert) may be provided for increasing friction with the kingpin.

Figure 40:
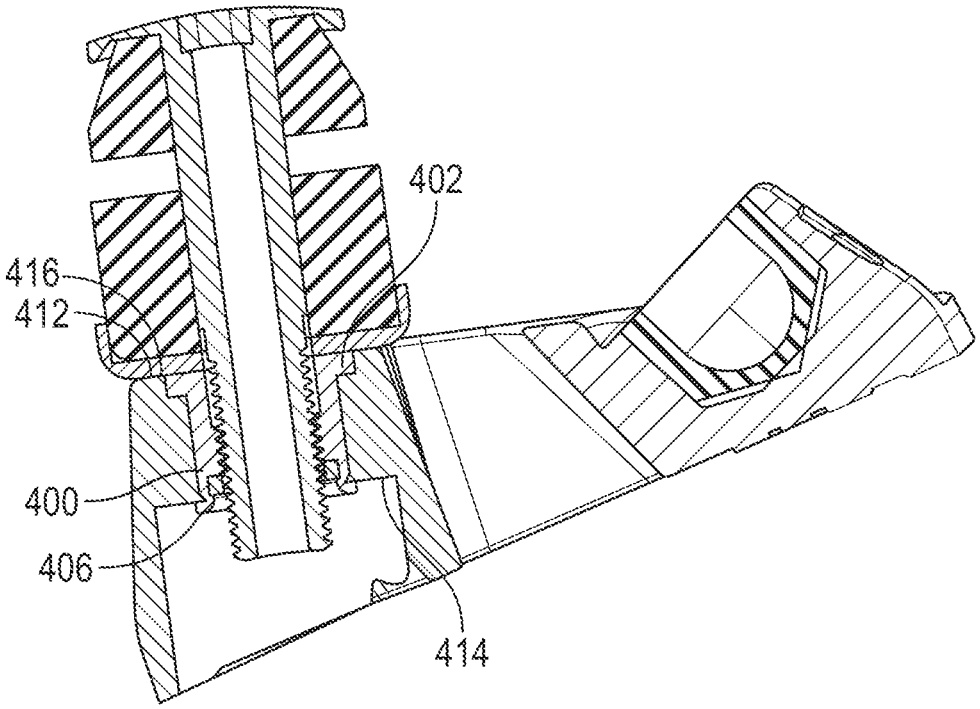
FIG. 40 illustrates a side cross sectional view of the sleeve shown in FIG. 39A inserted into the aperture of a baseplate.

FIG. 40 illustrates an implementation utilizing the flanged sleeve 400. The flange 402 is positioned at the top side support surface 412, and the flange 406 is positioned at the underside support surface 414. The flanges 402, 406 may aid in reduction of axial movement of the flanged sleeve 400 within the aperture 416. The flange 402 may be positioned within a stepped recess of the aperture 416. The flange 406 may protrude from the underside support surface 414 or may be within a stepped aperture and flush or co-planar with the underside support surface 414.

In examples, the flange 402 may protrude axially from the top side support surface 412. In examples, either flange 402, 406 may be axially recessed from the respective top side support surface 412 or the underside support surface 414.

Figure 41A:
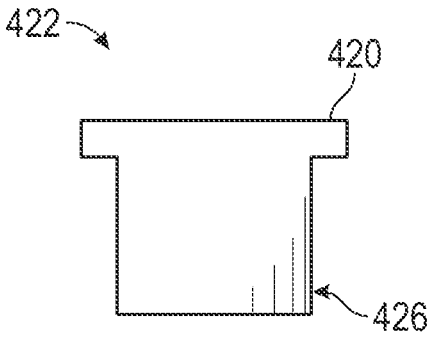
FIGS. 41A and 41B illustrate a process of forming a flange.
Figure 41B:
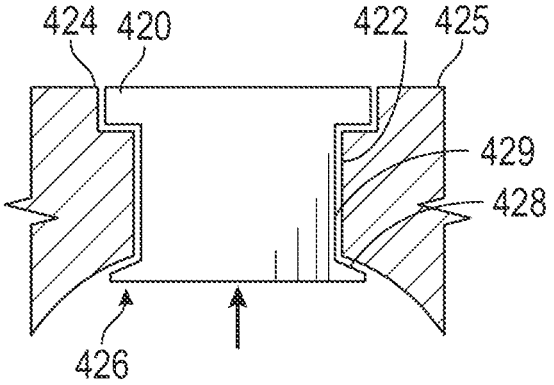

The flanges 402, 406 may be formed in a variety of manners. Referring to FIGS. 41A and B, for example, a first flange 420 may be prefabricated and the sleeve 422 may then be passed through the aperture 424 of the baseplate 425 as represented in FIG. 41B. The end portion 426 may be deformed upon application of a force to the end portion 426. A counter force (e.g., a force applied by a press) may form the second flange 428. The force may deform and cause the end portion 426 to expand radially outward to form the second flange 428. The second flange 428 may comprise a deformed end of the central shaft 429. Features of other shafts disclosed herein (e.g., flanged sleeve 400) may otherwise be incorporated with the flanged sleeves represented in FIGS. 41A-44B).

Figure 42A:
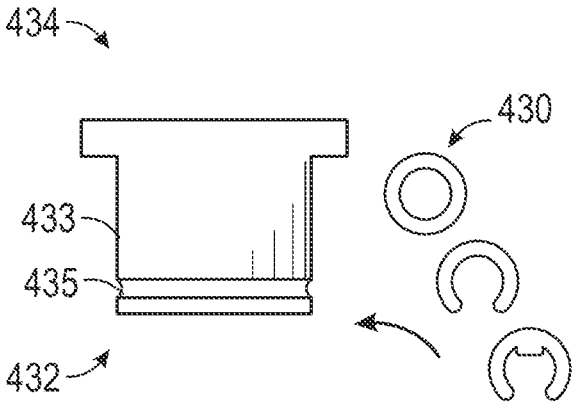
FIGS. 42A and 42B illustrate a process of forming a flange.
Figure 42B:
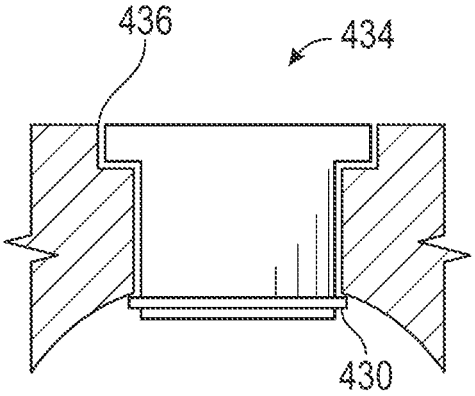

Referring to FIGS. 42A and B, in examples, one or more of the flanges may be non-integral with the central shaft of the flanged sleeve. A flange 430, for example, may comprise a fastener that is coupled to the central shaft 433 and engaged with the end portion 432 of the sleeve 434. The fastener, for example, may comprise one or more of a nut, a clip, or a ring, among other forms of fasteners. The fastener may engage with an engagement surface 435 or receiving portion of the sleeve 434 after the sleeve 434 has been passed through the aperture 436 of the baseplate. The engagement surface 435, for example, may comprise a portion of the exterior radially outward facing side surface of the sleeve, and may comprise a recess in the exterior surface for example. Other forms may be utilized in examples.

Figure 43A:
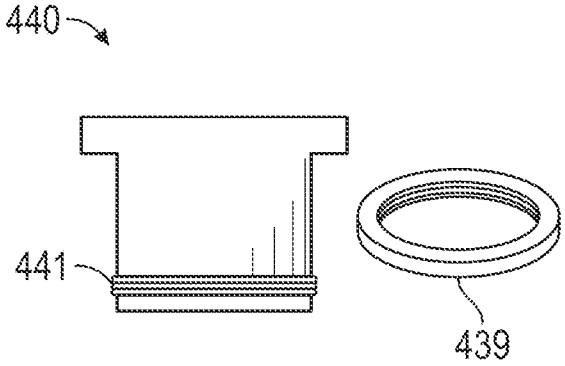
FIGS. 43A and 43B illustrate a process of forming a flange.
Figure 43B:
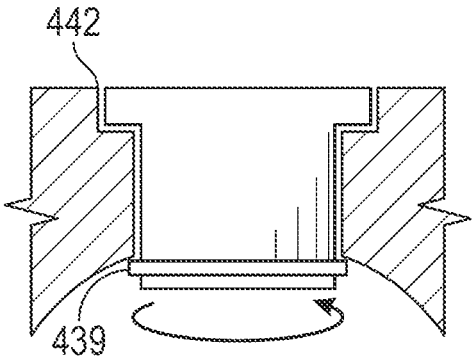

Referring to FIGS. 43A and B, in examples, the flange 439 may be threaded onto the sleeve 440 after the sleeve 440 passes through the aperture 442 of the baseplate. An engagement surface 441 of the sleeve 440 for engaging the flange 439, for example, may comprise a portion of the exterior surface of the sleeve, and may comprise threading of the exterior surface for example.

Figure 44A:
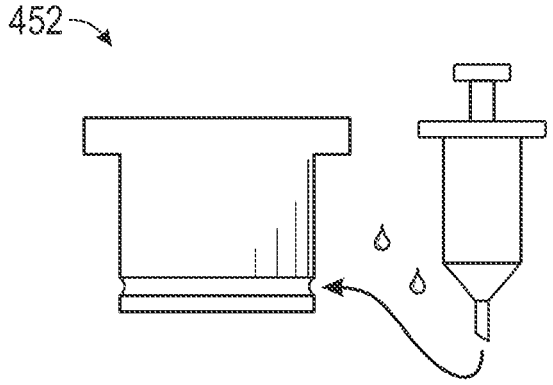
FIGS. 44A and 44B illustrate a process of forming a flange.
Figure 44B:
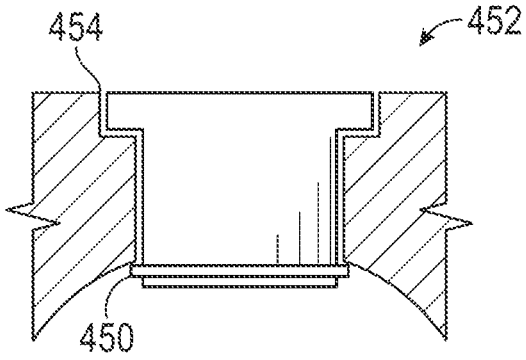

Referring to FIGS. 44A and B, in examples, a flange 450 may comprise a curable material that may be applied to the sleeve 452. The curable material, for example, may comprise a liquid (as represented with the syringe in FIG. 44A) that is dispensed to the sleeve 452. The liquid may cure after the sleeve 452 has been passed through the aperture 454 of the baseplate. In examples, the curable material may comprise an adhesive, although other forms of curable material may be utilized in examples. The curable material may be dispensed into a recess or other engagement surface of the sleeve 452 in examples. The curable material may harden and cure.

Features disclosed in regard to FIGS. 39A-44B may be utilized solely or in combination with any other example disclosed herein. The sleeves disclosed in regard to FIGS. 39A-44B may have a hardness and may thus provide for improved anchoring of the kingpin, in a similar manner as disclosed in regard to FIGS. 5-15.

In various examples, a skateboard such as the skateboard 10 shown in and described herein with respect to FIG. 1 may include any of the aforementioned skateboard trucks and their various components described herein.

A sleeve disclosed herein may be formed of a high-strength material (such as high-grade steel with HRC hardness 28-45). Sleeves disclosed herein may be press-fit into an aperture (e.g., a stepped aperture) on a top side of the truck baseplate. A sleeve (e.g., a flanged sleeve) may extend the full length of the aperture in the baseplate, or only a part of that length. The housing thus formed with the sleeve (e.g., flanged sleeve) may provide superior support to the kingpin compared to prior art constructions—holding it in more precise alignment, with minimized flexion, in an aperture less prone to wear and ovalization. Optionally with engagement features (e.g., knurls, flutes, or others) on the exterior diameter, a high-strength sleeve can also be more strongly press-fit inside the aperture, since it will not deform under high pressure.

Optional threading (full or partial) on an interior surface of the flanged sleeve, mating with threading on an exterior surface of the kingpin in inverted orientation, further protects the fastener from being dislodged. In such an example, the thread-lock mechanically stops the kingpin from pushing the fastener out of its pocket.

Examples include a sleeve made of high-strength material and having a length equal to, or less than, that of the baseplate aperture with or without outer surface engagement features (e.g., knurls/flutes) that strengthen press-fit inside baseplate aperture with or without interior surface threading (full or partial length of sleeve) that fastens to exterior surface threading of kingpin. Examples include optional tapered interior surface of a sleeve (e.g., a flanged sleeve) that matches a thickened and tapered exterior surface of an interfacing section of the kingpin in standard/non-inverted orientation (with or without threading). In another example, a sleeve (e.g., a flanged sleeve) in high-strength material may also include an optional stepped interior surface that matches a thickened and stepped exterior surface of the interfacing section of the kingpin in standard/non-inverted orientation (with or without threading).

In examples featuring an inverted kingpin orientation, features disclosed herein may protect the baseplate from catastrophic damage in the event that high impacts on the kingpin head push a fastener out of its place on the underside of the baseplate—even with bushings of normal height (which ensure full optimal steering range). In such examples, high impacts may not dislodge the sleeve due to its mechanically-locked seating, and a fastener (e.g., an ordinary locknut) can be easily repositioned or replaced, with no need for an entire new baseplate or truck.

Methods disclosed herein may comprise assembling all or a portion of any of the trucks or skateboards or other components disclosed herein. Methods disclosed herein may comprise utilization of all or a portion of any of the trucks or skateboards or other components disclosed herein.

Methods may include inserting one or more of the sleeves or other components disclosed herein into an aperture of a baseplate. A variety of methods (e.g., manual insertion, machine insertion, press insertion) may be utilized as desired. A kingpin may be inserted into the channel of the sleeve. A fastener may be provided as desired. Other components of a truck (e.g., bushings, arms, hanger, axle) may be assembled as desired. The trucks may be attached to a skateboard deck and other finishing processes may be applied.

In examples, the sleeves disclosed herein may be pre-inserted into an aperture of a baseplate and may be configured to be non-removable by a user. The sleeves may be securely fixed within the aperture. Further, the sleeves may lack a hex engagement surface, as the sleeves may be configured to be non-removable from the aperture of the baseplate. A smooth outer surface of the sleeves, or a surface having engagement features may be provided. Various other configurations may be utilized.

For purposes of this description, certain aspects, advantages, and novel features of the examples of this disclosure are described herein. The disclosed methods, apparatuses, and systems should not be construed as limiting in any way. Instead, the present disclosure is directed toward all novel and nonobvious features and aspects of the various disclosed examples, alone and in various combinations and subcombinations with one another. The methods, apparatuses, and systems are not limited to any specific aspect or feature or combination thereof, nor do the disclosed examples require that any one or more specific advantages be present or problems be solved. Features, elements, or components of one example can be combined into other examples herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any sub combination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some examples have been described in connection with the accompanying drawings. Components can be added, removed, and/or rearranged. Further, the disclosure herein of any particular feature, aspect, method, property, characteristic, quality, attribute, element, or the like in connection with various examples can be used in all other examples set forth herein. Additionally, it will be recognized that any methods described herein may be practiced using any device suitable for performing the recited steps.

While a number of examples and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments, as will be understood by those of ordinary skill in the art with the benefit of the present disclosure.

What is claimed is:

1. A skateboard truck, comprising:

a kingpin;

a baseplate configured to be attached to a skateboard deck, the baseplate including an aperture, the aperture including a sidewall bounding an interior of the aperture for receiving the kingpin; and a sleeve configured to extend within the aperture and including an interior channel for receiving the kingpin, the sleeve including an exterior surface having one or more grooves or ridges extending circumferentially about the exterior surface for engaging the sidewall of the aperture.

2. The skateboard truck of claim 1, wherein the one or more grooves or ridges are configured for a press fit with the sidewall of the aperture.

3. The skateboard truck of claim 2, wherein the one or more grooves or ridges include one or more of the grooves, and a material of the sidewall enters into the one or more grooves to grip the sleeve in position and resist axial movement of the sleeve.

4. The skateboard truck of claim 1, wherein the sleeve is made of a material that is harder than material that the baseplate is made out of.

5. The skateboard truck of claim 1, further comprising a retainer for engaging the kingpin within the interior of the aperture.

6. The skateboard truck of claim 5, wherein the retainer comprises a clip.

7. The skateboard truck of claim 6, wherein the sleeve includes an annular recess, and the clip is positioned within the annular recess.

8. The skateboard truck of claim 5, further comprising a securement ring for securing the retainer within the interior of the aperture.

9. The skateboard truck of claim 8, wherein the securement ring is configured to extend within the aperture and includes an exterior surface having one or more engagement features for engaging the sidewall of the aperture.

10. The skateboard truck of claim 1, further comprising a fastener for fastening the kingpin to the baseplate.

11. The skateboard truck of claim 1, wherein the baseplate includes an underside support surface for facing towards the skateboard deck and a top side support surface that is opposite the underside support surface, and the aperture extends from the underside support surface to the top side support surface.

12. The skateboard truck of claim 11, wherein the baseplate includes a pocket having the underside support surface.

13. A skateboard truck, comprising:

a baseplate having an aperture, the baseplate configured to be attached to a skateboard deck;

a flanged sleeve configured to extend within the aperture and including an interior channel, a first flange positioned at a first end portion of the flanged sleeve and extending radially outward from the first end portion, and a second flange positioned at a second end portion of the flanged sleeve that is opposite the first end portion and extending radially outward from the second end portion; and a kingpin configured to extend within the interior channel of the flanged sleeve.

14. The skateboard truck of claim 13, wherein the baseplate includes an underside support surface for facing towards the skateboard deck and a top side support surface that is opposite the underside support surface, and the first flange is configured to be positioned at the underside support surface and the second flange is configured to be positioned at the top side support surface.

15. The skateboard truck of claim 14, wherein the baseplate includes a pocket having the underside support surface.

16. A skateboard comprising:

a skateboard deck;

a pair of skateboard trucks coupled to the skateboard deck, each truck configured with:

a kingpin, a baseplate attached to the skateboard deck, the baseplate including an aperture, the aperture including a radially inward step and a sidewall bounding an interior of the aperture that receives the kingpin, a sleeve extending within the aperture and including an interior channel receiving the kingpin, the sleeve being seated upon the radially inward step with the radially inward step being positioned between the sleeve and the skateboard deck, and the sleeve including an exterior surface having one or more engagement features engaging the sidewall of the aperture, and a hanger with an axle supported by the baseplate; and a set of wheels coupled to each of the pair of skateboard trucks via each axle.

17. The skateboard of claim 16, wherein the one or more engagement features include a variation in a surface profile of the exterior surface.

18. The skateboard of claim 16, wherein the one or more engagement features include one or more grooves or ridges extending circumferentially about the sleeve and engaging the sidewall of the aperture.

19. The skateboard of claim 16, wherein the one or more engagement features have a press fit with the sidewall of the aperture.

20. The skateboard of claim 16, wherein the one or more engagement features are made of a material that is harder than the sidewall of the aperture.

* * * * *